US008672704B2

(12) United States Patent
de Bruijn et al.

(10) Patent No.: US 8,672,704 B2
(45) Date of Patent: Mar. 18, 2014

(54) ELECTRICAL CONNECTOR HAVING CRIMP-MOUNTED ELECTRICAL TERMINALS

(75) Inventors: Jeroen de Bruijn, Loon op Zand (NL); Thierry Goossens, Herdersem-Aalst (BE); Johannes Maria Blasius van Woensel, Rosmalen (NL)

(73) Assignee: FCI, Guyancourt (FR)

( * ) Notice: Subject to any disclaimer, the term of this patent is extended or adjusted under 35 U.S.C. 154(b) by 12 days.

(21) Appl. No.: 13/226,864

(22) Filed: Sep. 7, 2011

(65) Prior Publication Data

US 2012/0058668 A1 Mar. 8, 2012

Related U.S. Application Data

(60) Provisional application No. 61/437,543, filed on Jan. 28, 2011, provisional application No. 61/380,460, filed on Sep. 7, 2010, provisional application No. 61/380,438, filed on Sep. 7, 2010.

(51) Int. Cl.
*H01R 4/24* (2006.01)

(52) U.S. Cl.
USPC ..... 439/422

(58) Field of Classification Search
USPC ..... 439/423, 422, 424, 862
See application file for complete search history.

(56) References Cited

U.S. PATENT DOCUMENTS

| | | | |
|---|---|---|---|
| 3,315,621 | A | 4/1967 | Szymber |
| 3,612,747 | A | 10/1971 | Shlesinger, Jr. |
| D227,767 | S | 7/1973 | Gillespie |
| 4,082,402 | A | 4/1978 | Kinkaid et al. |
| 4,171,858 | A | 10/1979 | Knowles et al. |
| 4,371,225 | A | 2/1983 | Narozny |
| 4,560,226 | A | 12/1985 | Dennis |
| 4,564,253 | A | 1/1986 | Sinclair |
| 4,749,368 | A | 6/1988 | Mouissie |
| 4,784,623 | A | 11/1988 | Beck, Jr. |
| 4,832,620 | A | 5/1989 | Yamamoto |
| 5,567,545 | A | 10/1996 | Murakami |
| 5,631,098 | A | 5/1997 | Suzuki |
| D408,353 | S | 4/1999 | Yoshiura |
| D409,143 | S | 5/1999 | Yoshiura |
| D410,226 | S | 5/1999 | Yoshiura |
| 6,083,059 | A | 7/2000 | Kuan |

(Continued)

FOREIGN PATENT DOCUMENTS

| | | |
|---|---|---|
| TW | D116895 | 5/2007 |
| TW | D126581 | 12/2008 |
| TW | D127913 | 3/2009 |
| TW | D134355 | 4/2010 |

OTHER PUBLICATIONS

U.S. Appl. No. 29/369,322, filed Sep. 7, 2010, de Bruijn et al.
U.S. Appl. No. 29/369,327, filed Sep. 7, 2010, de Bruijn et al.

(Continued)

*Primary Examiner* — Phuong Dinh
(74) *Attorney, Agent, or Firm* — Baker & Hostetler LLP

(57) ABSTRACT

In accordance with one embodiment, an electrical connector includes a connector housing, and at least one electrical terminal supported by the connector housing. The electrical terminal defines a mating portion and a mounting portion, the mounting portion carrying a crimp member having crimp teeth configured to pierce through a flex cable when crimped so as to mount the flat flex cable to the mounting portion of the electrical terminal.

30 Claims, 23 Drawing Sheets

(56) References Cited

U.S. PATENT DOCUMENTS

| | | | |
|---|---|---|---|
| 6,129,168 | A | 10/2000 | Lotito et al. |
| 6,146,179 | A | 11/2000 | Denny et al. |
| D447,122 | S | 8/2001 | Harasawa et al. |
| 6,309,241 | B2 | 10/2001 | Nagai |
| 6,315,621 | B1 | 11/2001 | Natori et al. |
| 6,375,492 | B1 | 4/2002 | Hio |
| D473,192 | S | 4/2003 | Ouchi et al. |
| D481,996 | S | 11/2003 | Kihira |
| D485,807 | S | 1/2004 | Kao et al. |
| 6,755,679 | B2 | 6/2004 | Godefroy et al. |
| 6,835,089 | B2 | 12/2004 | Hayes et al. |
| 6,932,382 | B2 | 8/2005 | Hayes et al. |
| 6,933,445 | B1 | 8/2005 | Duesterhoeft et al. |
| 6,951,488 | B2 | 10/2005 | Hsieh |
| 6,953,356 | B2 | 10/2005 | Hisamatsu et al. |
| 7,001,205 | B2 | 2/2006 | Godefroy et al. |
| D528,985 | S | 9/2006 | Peng |
| 7,112,103 | B2 | 9/2006 | Zhang et al. |
| D529,443 | S | 10/2006 | Chien |
| D530,679 | S | 10/2006 | Li et al. |
| D538,228 | S | 3/2007 | Wang et al. |
| D555,093 | S | 11/2007 | Chien et al. |
| D555,095 | S | 11/2007 | Ho |
| D555,096 | S | 11/2007 | Peng |
| D555,131 | S | 11/2007 | Kim et al. |
| D556,131 | S | 11/2007 | Chien |
| D556,135 | S | 11/2007 | Dwan et al. |
| D559,180 | S | 1/2008 | Lai et al. |
| 7,335,068 | B2 | 2/2008 | Dwan et al. |
| 7,338,310 | B2 * | 3/2008 | Kumakura ..... 439/422 |
| D568,246 | S | 5/2008 | Wu et al. |
| D568,248 | S | 5/2008 | Chen et al. |
| D569,343 | S | 5/2008 | Hung et al. |
| D569,801 | S | 5/2008 | Chuang |
| D569,802 | S | 5/2008 | Long et al. |
| D570,288 | S | 6/2008 | Ma et al. |
| 7,445,518 | B2 | 11/2008 | Schneider nee Hild et al. |
| D582,348 | S | 12/2008 | Shiu |
| D584,231 | S | 1/2009 | Wu |
| D584,237 | S | 1/2009 | Zhu |
| D586,294 | S | 2/2009 | Lung |
| D596,575 | S | 7/2009 | Chen et al. |
| 7,556,503 | B2 | 7/2009 | Vinther |
| 7,575,439 | B2 | 8/2009 | Chen et al. |
| 7,585,192 | B1 | 9/2009 | Lai |
| D601,970 | S | 10/2009 | Peng et al. |
| D601,971 | S | 10/2009 | Chen et al. |
| 7,607,952 | B2 | 10/2009 | Tai |
| D603,795 | S | 11/2009 | Kono |
| D605,137 | S | 12/2009 | Yu et al. |
| D607,834 | S | 1/2010 | Huang |
| D607,835 | S | 1/2010 | Huang |
| D608,295 | S | 1/2010 | Huang |
| 7,662,507 | B2 | 2/2010 | Schwendinger et al. |
| D614,493 | S | 4/2010 | Creed et al. |
| D614,507 | S | 4/2010 | Lukan et al. |
| D614,583 | S | 4/2010 | Wang |
| D615,493 | S | 5/2010 | Kalis |
| D618,173 | S | 6/2010 | Wang et al. |
| D619,538 | S | 7/2010 | Peng |
| D630,586 | S | 1/2011 | Ngo |
| D640,201 | S | 6/2011 | Ngo |
| D642,981 | S | 8/2011 | de Bruijn et al. |
| D644,177 | S | 8/2011 | de Bruijn et al. |
| D647,863 | S | 11/2011 | Su et al. |
| D649,517 | S | 11/2011 | de Bruijn et al. |
| D659,645 | S | 5/2012 | Kajiura et al. |
| D659,646 | S | 5/2012 | Kajiura et al. |
| D664,177 | S | 7/2012 | Oikawa et al. |
| D666,151 | S | 8/2012 | Liao |
| D671,501 | S | 11/2012 | Kajiura et al. |
| D672,724 | S | 12/2012 | Kajiura et al. |
| 8,382,509 | B2 | 2/2013 | David et al. |
| 2002/0112985 | A1 | 8/2002 | Casses et al. |
| 2004/0038121 | A1 | 2/2004 | Song et al. |
| 2004/0137802 | A1 | 7/2004 | Wendling et al. |
| 2005/0287865 | A1 | 12/2005 | Wang et al. |
| 2006/0089018 | A1 | 4/2006 | Orita et al. |
| 2007/0202737 | A1 | 8/2007 | Wei et al. |
| 2007/0243458 | A1 | 10/2007 | Roehm et al. |
| 2008/0193837 | A1 | 8/2008 | Lu |
| 2009/0137136 | A1 | 5/2009 | Shen |
| 2011/0300759 | A1 | 12/2011 | Ngo |
| 2012/0214347 | A1 | 8/2012 | Sass et al. |

OTHER PUBLICATIONS

U.S. Appl. No. 29/369,333, filed Sep. 7, 2010, de Bruijn et al.
U.S. Appl. No. 29/384,323, filed Jan. 28, 2011, de Bruijn et al.
U.S. Appl. No. 29/384,325, filed Jan. 28, 2011, de Bruijn et al.
U.S. Appl. No. 29/393,268, filed Jun. 1, 2011, Kajiura et al.
U.S. Appl. No. 29/393,269, filed Jun. 1, 2011, Kameda et al.
U.S. Appl. No. 29/393,270, filed Jun. 1, 2011, Kajiura et al.
U.S. Appl. No. 29/393,276, filed Jun. 1, 2011, Kajiura et al.
U.S. Appl. No. 29/393,278, filed Jun. 1, 2011, Kameda et al.
U.S. Appl. No. 29/393,280, filed Jun. 1, 2011, Kajiura et al.
U.S. Appl. No. 29/393,281, filed Jun. 1, 2011, Kameda et al.
U.S. Appl. No. 29/393,282, filed Jun. 1, 2011, Kajiura et al.
U.S. Appl. No. 29/393,283, filed Jun. 1, 2011, Kameda et al.
U.S. Appl. No. 29/407,357, filed Nov. 28, 2011, de Bruijn et al.
U.S. Appl. No. 29/407,363, filed Nov. 28, 2011, Kajiura et al.
U.S. Appl. No. 29/407,370, filed Nov. 28, 2011, Kameda et al.
Taiwan Patent Application No. 100306484: Allowance Decision dated Aug. 17, 2012 with Search Report dated Jul. 24, 2012, 8 pages.
Taiwan Patent Application No. 100306485: Allowance Decision dated Aug. 20, 2012 with Search Report dated Jul. 24, 2012, 8 pages.
Taiwan Patent Application No. 100306491: Allowance Decision dated Aug. 17, 2012 with Search Report dated Jul. 24, 2012, 8 pages.
Taiwan Patent Application No. 100306483: Allowance Decision dated Aug. 20, 2012 with Search Report dated Jul. 24, 2012, 8 pages.

* cited by examiner

ELECTRICAL CONNECTOR HAVING CRIMP-MOUNTED ELECTRICAL TERMINALS

CROSS-REFERENCE TO RELATED APPLICATIONS

This claims the benefit of U.S. Provisional Patent application Ser. No. 61/380,460 filed Sep. 7, 2010, U.S. Provisional Patent application Ser. No. 61/380,438 filed Sep. 7, 2010, and U.S. Provisional Patent application Ser. No. 61/437,543 filed Jan. 28, 2011, the disclosure of each of which is hereby incorporated by reference as if set forth in its entirety herein.

The present application is related by subject matter to U.S. patent application Ser. No. 29/369,322 filed Sep. 7, 2010, U.S. patent application Ser. No. 29/369,333 filed Sep. 7, 2010, U.S. patent application Ser. No. 29/384,323 filed Jan. 28, 2011, and U.S. patent application 29/384,325 filed Jan. 28, 2011, U.S. patent application Ser. No. 29/393,270 filed Jun. 1, 2011, U.S. patent application Ser. No. 29/393,276 filed Jun. 1, 2011, U.S. patent application Ser. No. 29/393,280 filed Jun. 1, 2011, and U.S. patent application Ser. No. 29/393,282 filed Jun. 1, 2011. The subject matter of each of the above-identified patent applications is hereby incorporated by reference as if set forth in its entirety herein.

TECHNICAL FIELD

The present disclosure relates to electrical connectors, and in particular relates to an electrical terminal including a crimp fitting.

BACKGROUND

Electrical connectors conventionally include a housing that retains a plurality of electrically conductive terminals that define opposed mounting ends and mating ends configured to be placed in electrical communication with respective first and second complementary electrical devices. For instance, flat flex cables are widely used to connect the first electrical device to the mounting end of an electrical connector. Accordingly, when the electrical connector is mated to the second electrical device, the first and second electrical devices are placed in electrical communication. Flat flex cables have found increasing use as a replacement for costly and, in particular, heavy-weight cable harnesses.

SUMMARY

In accordance with one embodiment, an electrical terminal includes a mating portion and a mounting portion that is integral with the mating portion. The mating portion is configured to removably electrically connect to an electrical terminal of a complementary electrical component. The mounting portion carries a crimp member. The crimp member has flexible crimp teeth configured to pierce through a flex cable along a first direction, and further configured to fold back and pierce into the flat flex cable along a second direction substantially opposite the first direction when crimped so as to mount the flat flex cable to the mounting portion of the electrical terminal. The crimp member extends from the mounting member along a direction that is substantially parallel to a direction in which the mating portion is spaced from the mounting portion.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION

Figure 1:
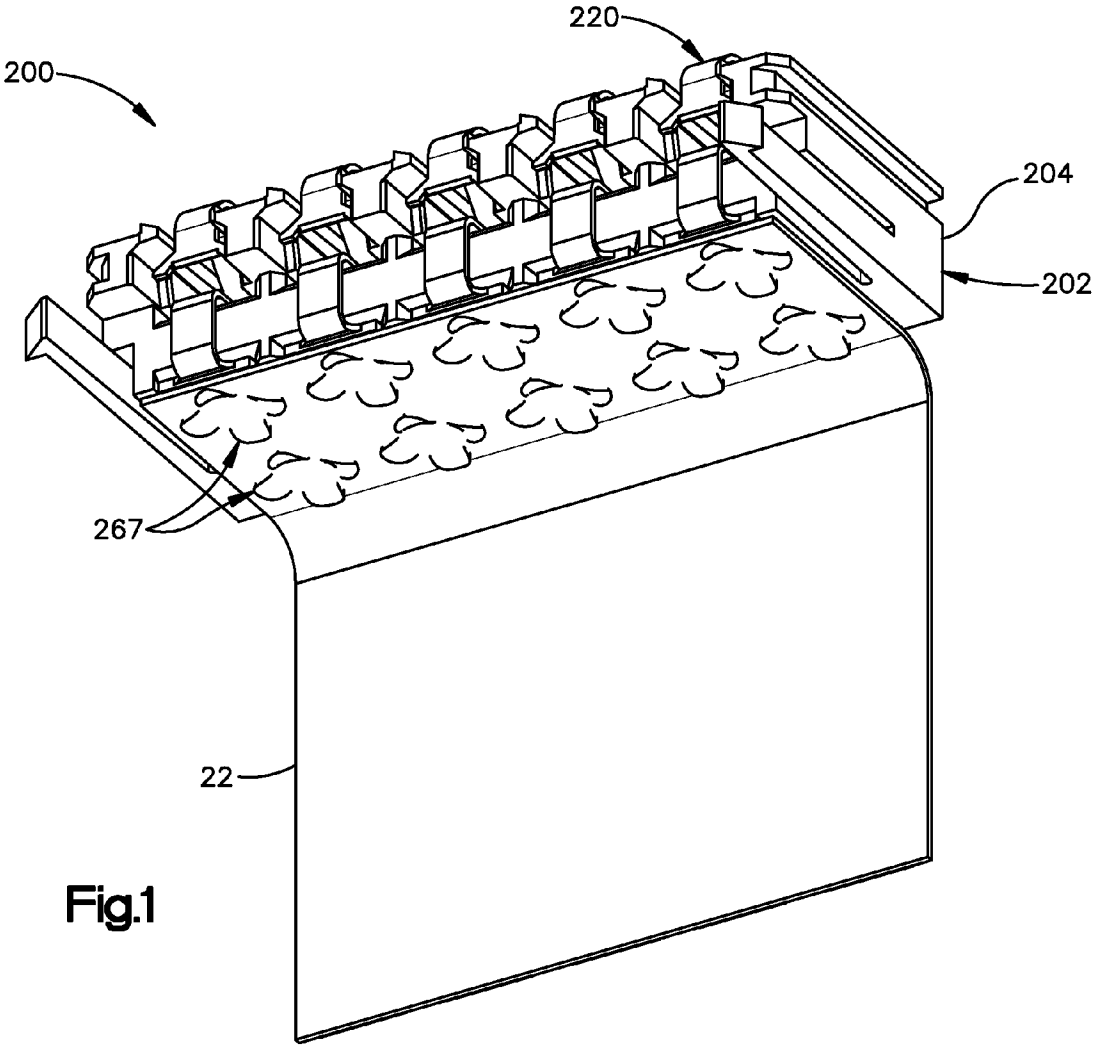
FIG. 1 is a perspective view of an electrical connector assembly including an electrical connector and a flat flex cable mounted to the electrical connector.
Figure 2A:
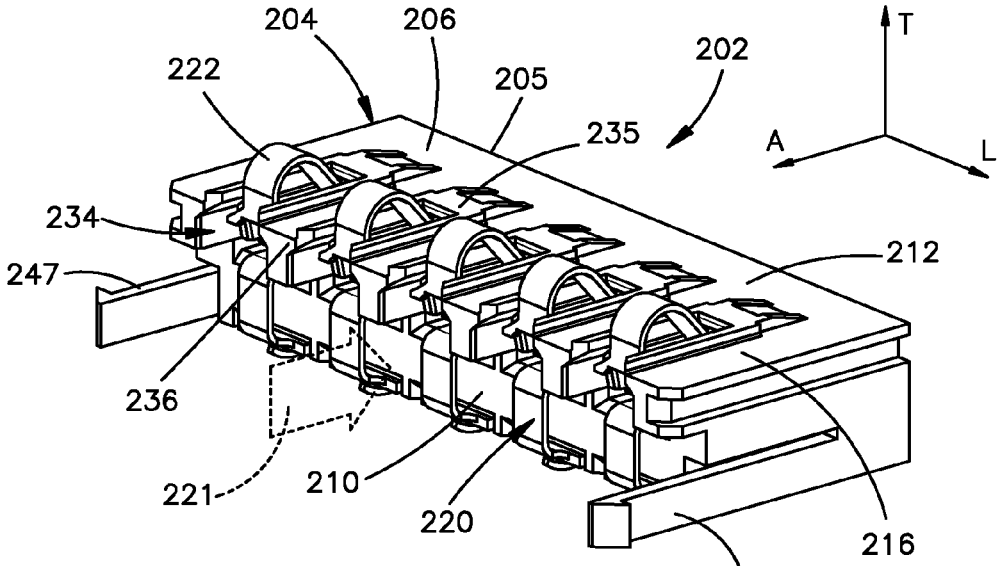
FIG. 2A is a perspective view of the electrical connector illustrated in FIG. 1.
Figure 2B:
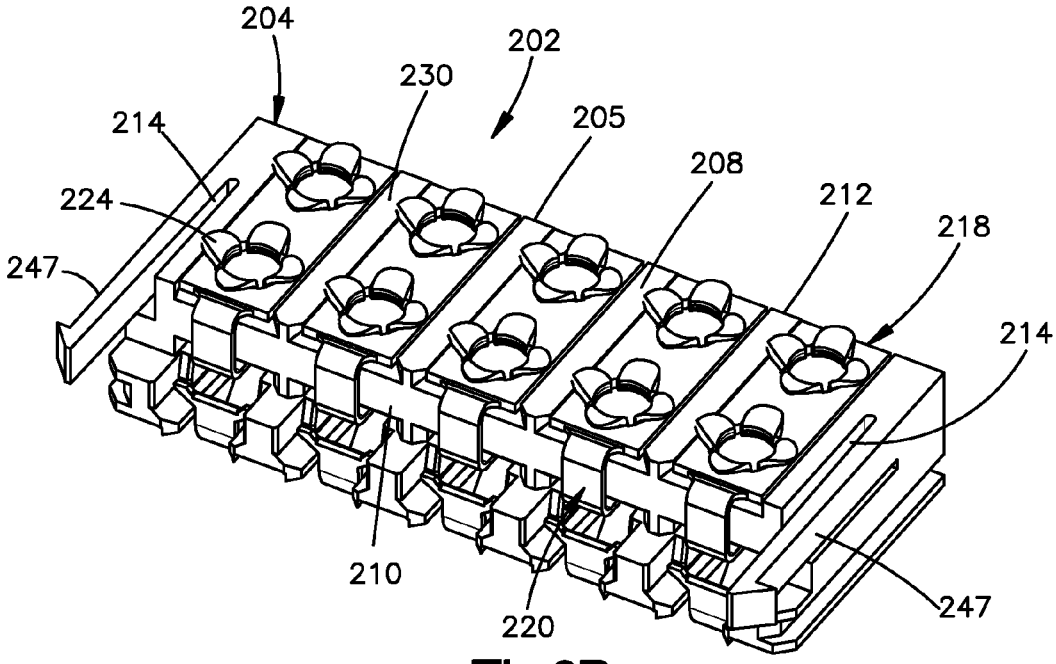
FIG. 2B is another perspective view of the electrical connector illustrated in FIG. 2A.

Referring initially to FIGS. 1-2B, an electrical connector assembly 200 includes an electrical connector 202 and a flat flex cable, also referred to as a flexible printed circuit (FPC) 22 that is configured to be mounted onto the electrical connector 202. The electrical connector 202 includes a connector housing 204 that is dielectric or electrically insulative. The connector housing 204 includes a substantially rectangular housing body 205 that defines a top end 206, an opposed bottom end 208, a front end 210, an opposed rear end 212, and opposed sides 214. The opposed sides 214 are spaced apart along a longitudinal direction L, the front end rear ends 210 and 212 are spaced apart along a lateral direction A that is substantially perpendicular with respect to the longitudinal direction L, and the top and bottom ends 206 and 208 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the electrical connector 202 may vary during use. In accordance with the illustrated embodiment, the connector housing 204 is illustrated as elongate in the longitudinal direction.

The connector housing 204 defines a mating interface 216 disposed proximate to the top end 206, and a mounting interface 218 disposed proximate to the bottom end 208. The mounting interface 218 is configured to operatively engage the flat flex cable 22, while the mating interface 216 is configured to operatively engage a second complementary electrical connector.

The electrical connector 202 includes a plurality of electrical terminals 220 that are electrically conductive and retained by the connector housing 204. The electrical connector 202 can include any number of electrical terminals 220 as desired. The electrical terminals 220 each define a mating portion 222 that is configured to electrically connect, for instance removably electrically connect, to a complementary electrical terminal of the complementary electrical component that is mated with the electrical connector 202, and an opposed mounting portion 224 that is configured to electrically connect to the flat flex cable 22. The mating portion 222 is disposed proximate to the mating interface 216, and the opposed mounting portion 224 is disposed proximate to the mounting interface 218. In particular, the mating portions 222 extend substantially laterally along the top end 206 of the connector housing 204, and can extend out from the top end 206, and the mounting portions 224 of the electrical terminals 220 can extend substantially laterally along the bottom end 208, and can extend out from the bottom end 208. Thus, the mating portion 222 faces out from a first housing surface of the connector housing 204, which can define the top end 206, and the mounting portion 224 faces out from a second housing surface of the connector housing, which can define the bottom end 208.

Figure 3A:
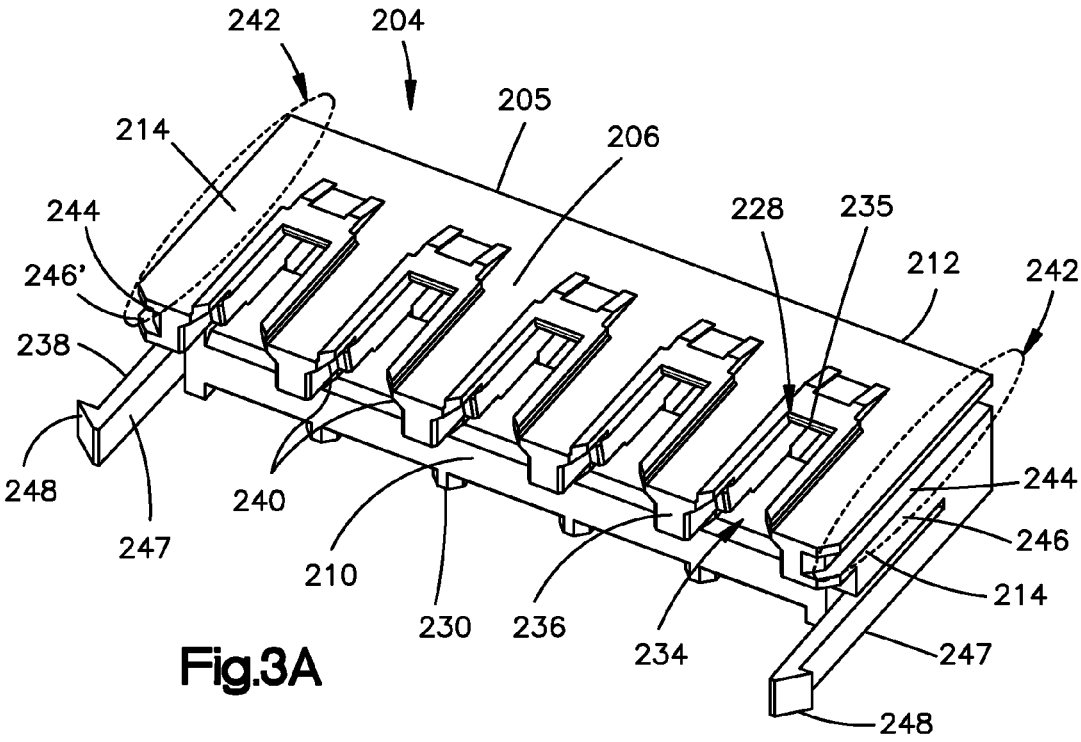
FIG. 3A is a perspective view of an electrical connector housing of the electrical connector illustrated in FIGS. 2A-B.
Figure 3B:
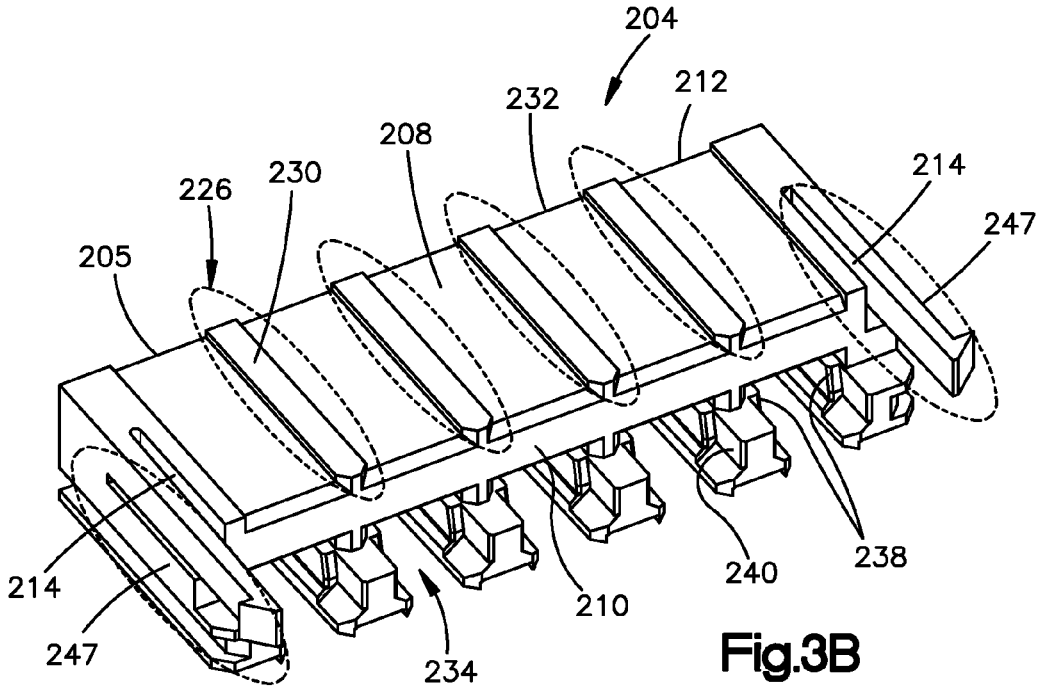
FIG. 3B is another perspective view of the electrical connector housing illustrated in FIG. 3A.

Referring now to FIGS. 3A-B, the connector housing 204 includes a plurality of contact alignment members 226 and contact retention members 228 carried by the housing body 205. The contact alignment members 226 are configured to retain the electrical terminals 220 in a desired aligned configuration on the connector housing 204, and the contact retention members 228 are configured to retain the electrical terminals 220 in the aligned configuration. In accordance with the illustrated embodiment, the alignment members 226 are illustrated as ribs 230 that project out from the housing body 205, so as to create retention slots 232 disposed between adjacent ribs 230. In particular, the ribs 230 are illustrated as projecting transversely out, or down, from the bottom end 208 of the housing body 205. The ribs 230 are laterally elongate, and extend from the rear end 212 to the front end 210 of the housing body 205, though it should be appreciated that the ribs 230 can define any size and shape as desired. The retention slots 232 are at least partially defined by adjacent ribs 230 and the bottom end 208 of the housing body 205 and are thus recessed with respect to the transverse outer surface of the ribs 230.

The contact retention members 228 are illustrated as retention pockets 234 that extend down, transversely into, the top end 206 of the housing body 206. The connector housing 204 defines a plurality of divider walls 236 disposed between adjacent pockets 234. The retention pockets 234 extend laterally rearward from the front end 210 toward the rear end 212, and terminates such that the housing body 205 defines an overhang 235 that forms an upper wall of the rear end of the pockets 234. Thus, the retention pockets 234 extend under the overhang 235. The divider walls 236 can extend forward beyond the front end 210 of the housing body 205, and can further define side walls 238 that define the lateral boundaries of the retention pockets 234. The divider walls 236 can define a notch 240 that extends into the side walls 238 to facilitate initial insertion and subsequent retention of the electrical terminals 220 in the retention pockets 234.

The connector housing 204 can further include at least one engagement member 242 that is configured to engage a complementary engagement member of a complementary apparatus that retains the electrical connector 202 in a mated configuration with a complementary electrical device. For instance, the complementary engagement member can be disposed on or carried by the complementary electrical device, or can be disposed on or carried by an auxiliary structure that engages the electrical connector 202 so as to assist in the retention of the electrical connector 202 in the mated configuration with the complementary electrical device.

As illustrated in FIGS. 3A-B, the engagement member 242 can include a pair of guide rails 244 provided as slots 246 that extend longitudinally into the opposed sides 214 of the housing body 205, and are laterally elongate between the front and rear ends 210 and 212, respectively. As illustrated, the slots 246 can extend from the rear end 212 to the front end 210. The guide rails 244 are configured to receive a complementary guide member as the electrical connector 202 is mated with the complementary electrical connector.

Figure 6A:
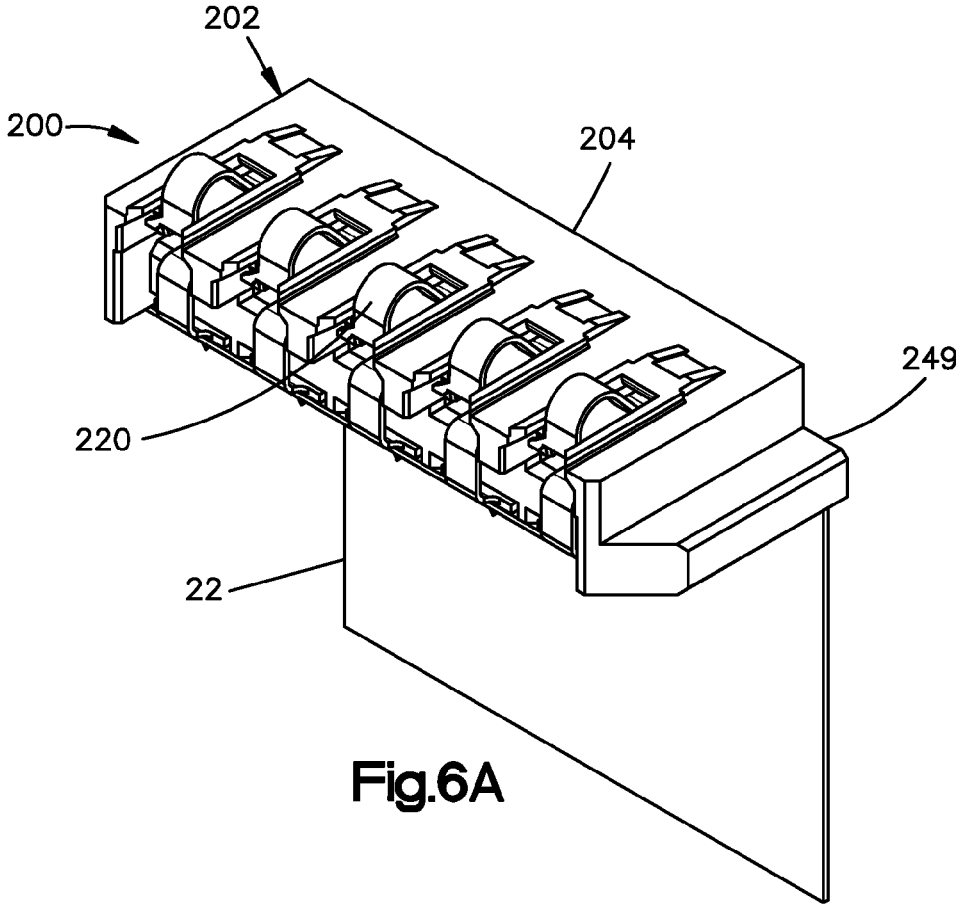
FIG. 6A is a perspective view of an electrical connector similar to the electrical connector illustrated in FIG. 1, but including an electrical connector housing constructed in accordance with an alternative embodiment.

The engagement member 242 can further include a pair of latch arms 247 that extend forward from the housing body 205. For instance, the latch arms 247 extend forward from the opposed sides 214 at a location vertically offset from (for instance below) or alternatively vertically aligned with the guide rails 244. The latch arms 247 can define an outwardly barbed forward end 248 that is configured to engage or interlock with a complementary engagement member of the complementary apparatus so as to retain the electrical connector 202 in the mated configuration with the complementary electrical device. Alternatively, as illustrated in FIG. 6A, the engagement member 242 of the electrical connector 202 can include a pair of guide rails 249 that extend laterally out from the sides 214 of the connector housing 204, and are elongate between the front and rear ends 210 and 212. Thus, it should be appreciated that the electrical connector 202 is illustrated in accordance with one embodiment, and the electrical connector 202 could be constructed in accordance with numerous embodiments so as to electrically connect a pair of complementary electrical devices.

Figure 4:
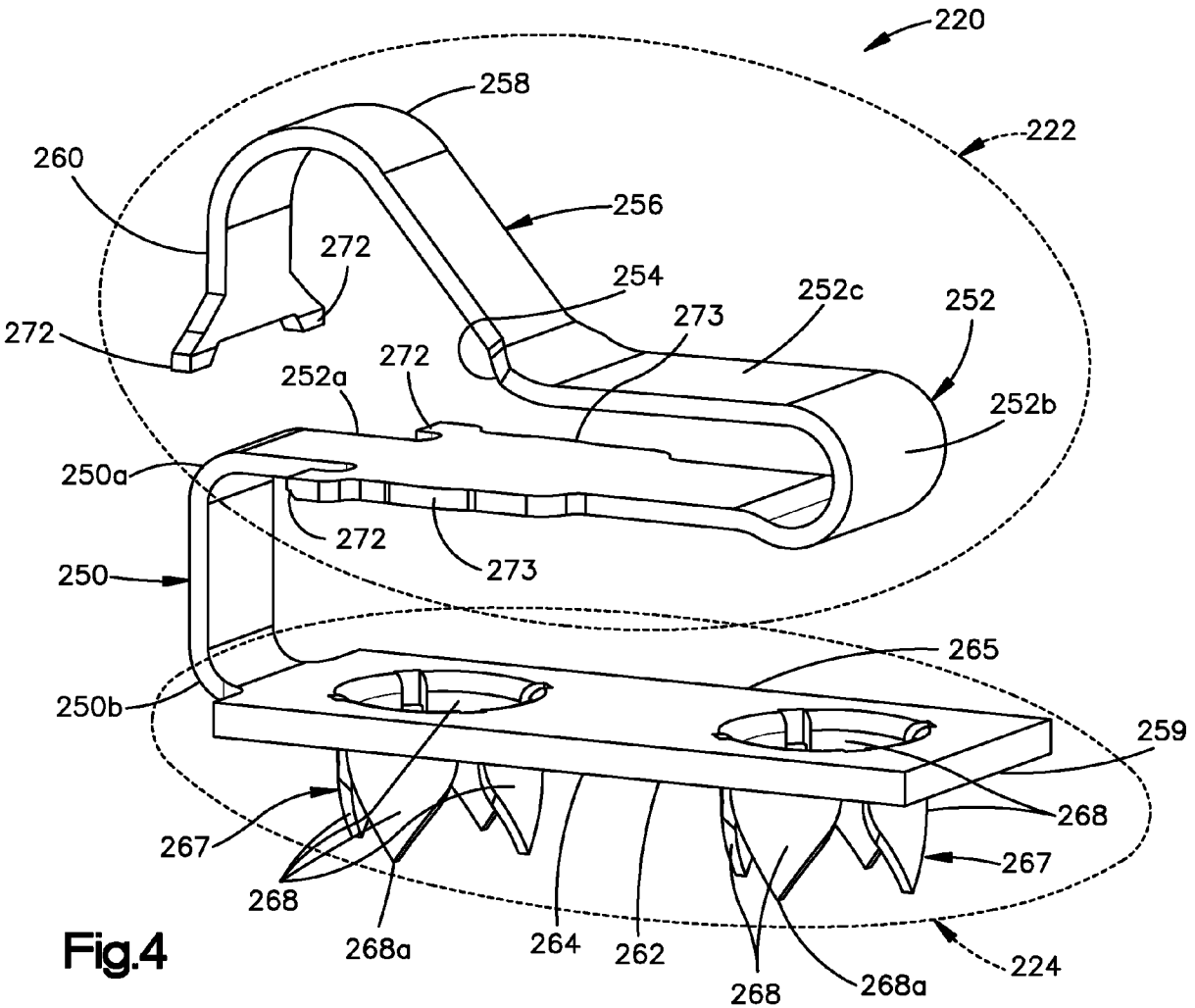
FIG. 4 is a perspective view of an electrical terminal of the electrical connector illustrated in FIGS. 2A-2B.

Referring now to FIG. 4, each of the electrical terminals 220 can be configured as a battery terminal, and can include a terminal body that defines a mating portion 222 and a mounting portion 224, and an intermediate portion 250 connected between the mating portion 222 and the mounting portion 224. In accordance with the illustrated embodiment, the mating portion 222, the mounting portion 224, and the intermediate portion 250 are integral with each other. Furthermore, in accordance with the illustrated embodiment, the mating portion 222 and the mounting portion 224 each extend from respective first and second spaced locations of the intermediate portion 250 along the same direction, such that the mating portion 222 and the mounting portion 224 are aligned in the transverse direction T. Accordingly, a line that extends in the transverse direction T passes through both the mating portion 222 and the mounting portion 224. The intermediate portion 250 is illustrated as a leg that extends vertically and defines a first or top end 250*a* that can define the first location, and an opposed second or bottom end 250*b* that is spaced from the top end 250*a* and can define the second location. Thus, the mating portion 222 extends from and is cantilevered from the top end 250*a*, and the mounting portion 224 extends from and is cantilevered from the bottom end 250*b*.

In accordance with the illustrated embodiment, the mating portion 222 includes an arm 252 that defines a proximal region 252*a*, a distal region 252*c*, and a flexible intermediate bent region 252*b* that is connected between the proximal region 252*a* and the distal region 252*c*. The proximal region 252*a* extends laterally rearward from the top end 250*a* of the intermediate portion 250 in a direction angularly offset from the intermediate portion 250. As illustrated, the proximal region 252*a* of the mating portion 222 extends substantially perpendicular with respect to the intermediate portion 250. The intermediate region 252*b* is bent, and can define a substantially u-shaped bend of substantially 180° from the rear end of the proximal region 252*a* in accordance with the illustrated embodiment. Accordingly, the distal region 252*c* extends forward from the intermediate region 252*b* along a direction substantially parallel to the proximal region 252*a* to an elbow 254, and a contact portion 256 that extends forward and transversely out from the elbow 254. The contact portion 256 is illustrated as substantially hook-shaped and defines a first contact surface 258 and a distal end 260 that extends down from the contact surface 258 toward the intermediate portion 250. The distal end 260 can be substantially vertically aligned with the intermediate portion 250 as illustrated in the transverse direction T.

The mounting portion 224 can include a mounting member that can be configured as a substantially planar mounting plate 262 that extends laterally rearward from the bottom end 250*b* of the intermediate portion 250 in a direction angularly offset from the intermediate portion 250. As illustrated, the mounting plate 262 extends substantially flat in the horizontal plane, along a direction substantially perpendicular with respect to the intermediate portion 250 and substantially parallel to the proximal region 252*a* of the mating portion 222. The mounting plate 262 defines an outer transverse or lower first contact surface 264, and an opposed inner transverse or upper second surface 265. The mounting plate 262 can have a transverse thickness greater than a remaining portion of the electrical terminal 220, or can have a substantially constant thickness with respect to the remaining portion of the electrical terminal 220.

The mounting potion 224 further includes at least one crimp member 267, such as a pair of laterally spaced crimp members 267, carried by the mounting plate 262. In particular, each crimp member 267 includes a plurality of crimp teeth 268 that extend down from the contact surface 264 to a tapered distal end 268*a* in accordance with the illustrated embodiment. Thus, each crimp member 267 can extend from the mounting plate 262, for instance from the contact surface 264, along a direction that is substantially parallel to the direction in which the mating portion 222 is spaced from the mounting portion 224. For instance, each crimp member 267 can extend from the mounting plate along a direction away from the mating portion 222, and thus away from the proximal and distal regions 252*a* and 252*c*, and thus further away from the contact surface 258. The proximal region 252*a* can be disposed between the distal region 252*c* and the mounting plate 262, and thus between the distal region 252*c* and the crimp members 267. The electrical connector housing 204 defines first and second opposed housing surfaces that can define the top end 206 of the connector housing 204 and the bottom end 208 of the connector housing 204, respectively. A first one of the opposed first and second housing surfaces, for instance at the top end 206, is configured to mate with a complementary connector, and the opposed second housing surface, for instance at the bottom end 208, is configured to secure the flat flex cable 22. The electrical terminals 220 define respective mating portions 222 that face outwardly from the first housing surface along a first direction, and the crimp teeth 268 face outwardly from the second housing surface along a second direction that is angularly offset from the first direction. For instance, the second direction can be opposite the first direction, or can alternatively be substantially perpendicular to the first direction. The electrical terminals 220 define respective mating portions 222 that face outwardly from the first surface, and the crimp teeth 268 face outwardly from the second surface. Furthermore, the electrical terminal 220 defines first and second opposed surfaces, for instance at the mating portion 222 of the electrical terminal 220 and at the mounting portion 224 of the electrical terminal 220. A first one of the opposed surfaces, for instance at the mating portion 222, is configured to mate with a complementary connector, and the opposed second surface that faces opposite the first surface, for instance at the mounting portion 224, is configured to secure the flat flex cable 22.

As illustrated, the crimp teeth 268 can be stamped or otherwise cut from the mounting plate 262 so as to produce an aperture 270 that extends transversely through the mounting plate 262. Alternatively, the crimp teeth 268 can be discretely attached (e.g., welded) to the mounting plate 262. Each crimp member 267 includes four crimp teeth 268 that are equidistantly spaced from each other about a transverse aperture 270 that extends through the mounting plate 262. The crimp teeth 268 of each crimp member 267 can be arranged about a circumference or other curved surface such that each crimp member 267 resembles the shape of a star in accordance with the illustrated embodiment. It should be appreciated, however, that each crimp member 267 can include any number of crimp teeth 268, such as at least one crimp tooth 268, that are spaced equidistantly or variably from each other.

During operation, at least one of the electrical terminals 220 up to all of the electrical terminals 220 can be configured so as to provide a spring force that has a directional component substantially normal to the contact surface 258 at the mating portion 222. For instance, the contact surface 258 can be brought into mechanical and electrical contact with a complementary electrical terminal such that the mating portion 222 is placed in compression, thereby reliably mating the mating portion 222 to the complementary electrical terminal. For instance, when the contact surface 258, and thus the distal region 252*c*, receives a force in the transverse direction T toward the proximal region 252*a* and thus toward the mounting portion 224 (for instance applied by the complementary electrical terminal), the intermediate bent region 252*b* flexes such that the distal region 252*c* compresses along the transverse direction T toward the proximal region 252*a*, and thus toward the mounting portion 224. When the crimp members 267 extend from the mounting plate 262 along a direction away from the mating portion 222, and thus away from the proximal and distal regions 252*a* and 252*c*, and thus further away from the contact surface 258, then the proximal region 252*a* flexes along a direction that is substantially the same as a direction from which the crimp members 267 extend out from the mounting plate 262.

Referring again to FIGS. 2A-B and FIG. 4, the electrical connector 202 can be assembled by attaching the electrical terminals 220 to the electrical connector housing 204. For instance, electrical terminals 220 are first aligned with a corresponding one of the retention slots 232 and an aligned one of the retention pockets 234. Next, each electrical terminal 220 is mounted onto the connector housing such that the front end 210 of the connector housing 204 is received in a gap disposed between the mounting plate 262 and the proximal end 252*a* of the retention arm 252. The mounting plate 262 is received in the aligned retention slot 232, and the arm 252 is received in the aligned retention pocket 234. The electrical terminal 220 is translated rearward with respect to the connector housing 204 until the intermediate region 252*b* abuts the front end of the housing body 205.

When the electrical terminals 220 are mounted onto the connector housing 204, the mounting plate 262 of each terminal is disposed in the aligned retention slot 232, and the arm 252 is received in the aligned retention pockets 234. The outer transverse surfaces of the proximal and distal regions 252*a* and 252*b* of the arm 252 can define a transverse thickness that is slightly less than that of the retention pocket 234 at a location under the overhang 235, such that the arm 252 can be press-fit into the retention pocket 234.

Furthermore, each electrical terminal 220 can include at least one retention member configured to secure the electrical terminals 220 on the connector housing 204. For instance, the retention member can include a first group of one or more tangs 272 that protrude laterally outward, for instance from the proximal regions 252*a* of the retention arm 252. The tangs 272 are configured to be press-fit in the side walls 238, for instance in the notches 240. The retention member can further include a projection 273 that extends out from the proximal regions 252*a* at a location rearward with respect to the tangs 272. The projections 273 can extend laterally outward to a location that is recessed with respect to that of the tangs 272, such that the projections can be press-fit against the side walls 238 at a location rearward of the notches 240. The retention member can further include a second group of one or more tangs 272 that protrude obliquely out from the distal end 260 of the contact portion 256. The tangs 272 can also be press-fit against the side walls 238 as desired. Additionally, the rear ends of the proximal and distal regions 252*a* and 252*c* of the retention arm 252, along with the intermediate region 252*b*, can be press-fit under the overhang 235, such that the proximal and distal regions 252*a* and 252*c* are compressed between the overhang 235 and the base of the pocket 234. While the electrical terminal 220 has been described in accordance with the illustrated embodiment, it should be appreciated that the electrical terminals 220 can assume any suitable alternative size and shape as desired. It should be appreciated that the proximal region 252*a*, including the retention member, can be disposed over and overlap the mounting portion 224, including the crimp members 267. Furthermore, the distal region 252*c*, including the contact surface 258, can be disposed over and overlap the proximal region 252*a*, including the retention member, and can further be disposed over and overlap the mounting portion 224, including the crimp members 267.

The electrical terminals 220 can be mounted onto the connector housing 204 along a rearward mounting direction 221 (see FIG. 2A). Once the electrical terminals 220 have been installed on the connector housing 204, the mating portions 222 of the terminals 220 is configured to be placed in electrical communication with a complementary electrical device, which can be any device as desired such as a sensor or processor, or can alternatively be a complementary electrical connector, which is in turn electrically connected to another electrical device, such as a sensor or processor. The mating portions 222 can be compliant, so as to be spring biased in contact with complementary electrical terminals of the complementary electrical device.

Figure 5A:
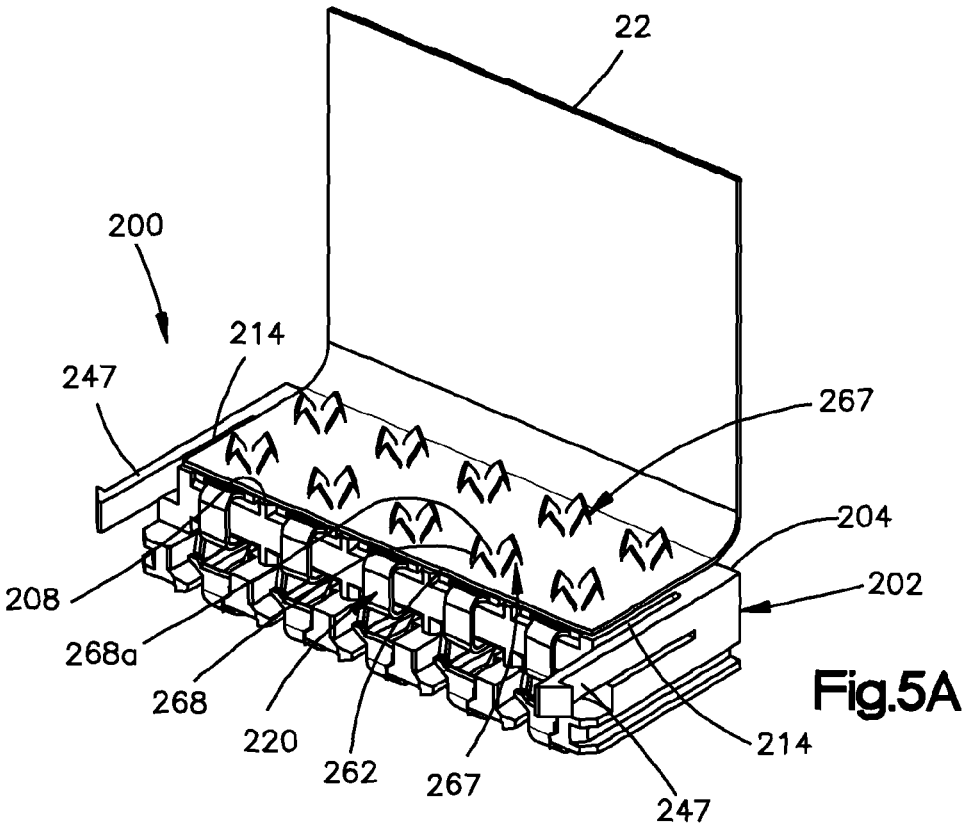
FIG. 5A is a perspective view of the electrical connector assembly illustrated in FIG. 1, showing the flat flex cable mounted to the electrical connector in an uncrimped configuration.
Figure 5B:
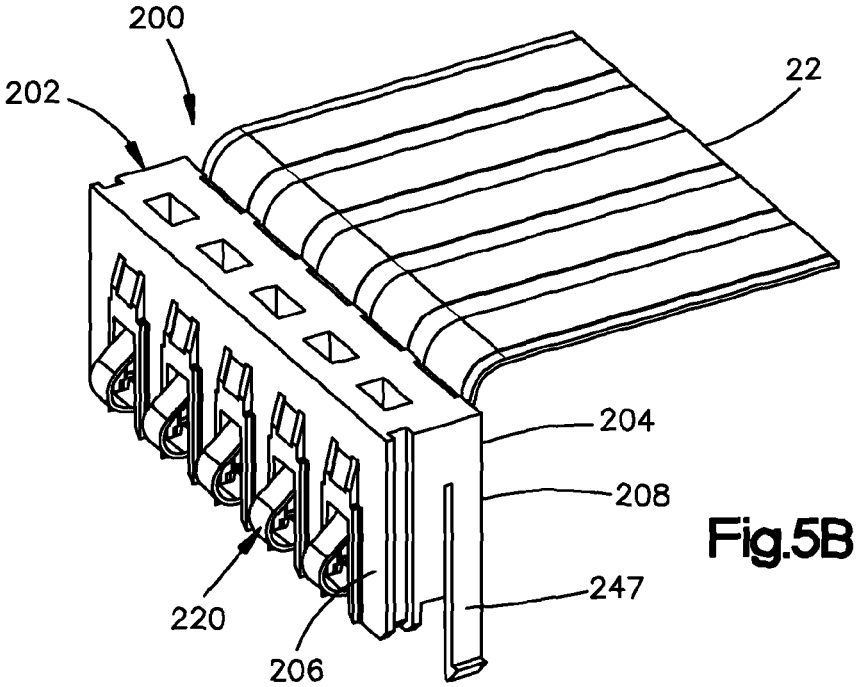
FIG. 5B is another perspective view of the electrical connector assembly illustrated in FIG. 5A.

Referring now to FIGS. 2A-B and 5A-B, the mounting portions 224 can be electrically connected to the flat flex cable 22 by crimping the crimp teeth 268 onto the flat flex cable 22, thereby placing the electrical terminals 220 in electrical communication with the electrical traces that run through the flat flex cable 22. For instance, the flat flex cable 22 can be placed against the bottom end 208 of the connector housing 204 such that the crimp teeth 268 pierce through the flat flex cable 22 along a first direction as shown in FIG. 5A. Next, the crimp member 267 can be stamped with a die, which is brought against the crimp teeth 268, causing the crimp teeth 268 to fold back along a second direction substantially opposite the first direction such that the tapered distal ends 268*a* pierce the flat flex cable 22 and contact the traces running therethrough (see FIG. 1). Thus, the crimp teeth 268 can be flexible so as to fold back under the stamping force. The stamping operation can cause the crimp teeth 268 to fold outward or inward as desired. Thus, as the die is brought into contact with the crimp teeth 268, the bottom end 208 of the connector housing 204 provides a mandrel that supports the stamping operation.

Figure 5C:
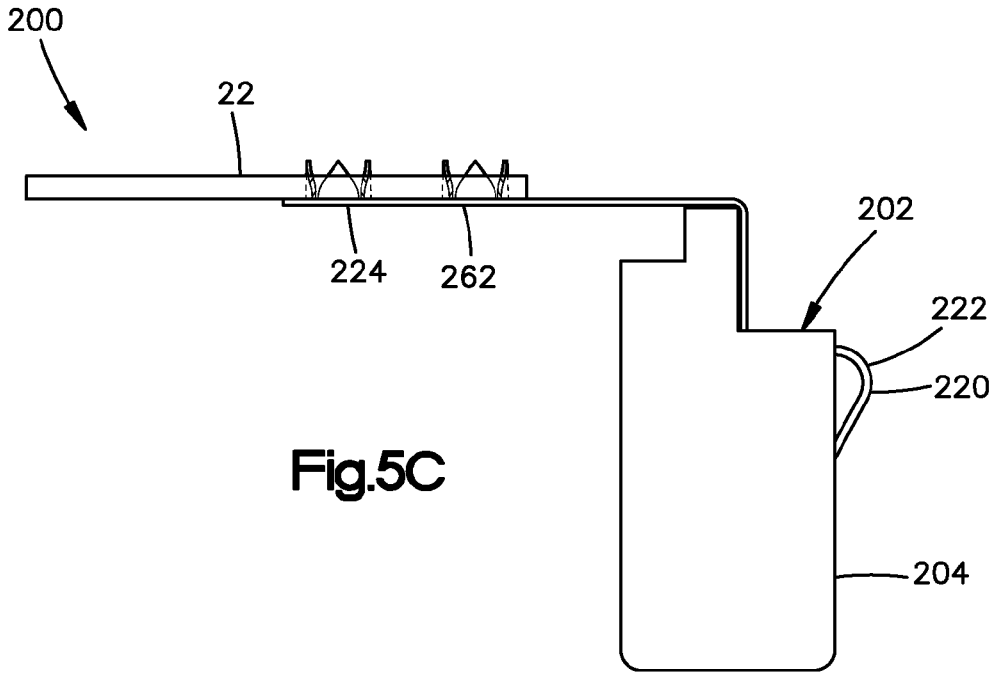
FIG. 5C is another perspective view of the electrical connector assembly, showing the flat flex cable mounted to an electrical terminal of the electrical connector.

In order to reduce the crimp forces applied to the connector housing 204 during the stamping operation, the connector housing 204 can be reinforced with a plate or any suitable structure, such as a reinforcement tool that can support the inner surface of the connector housing 204 at the crimp members 267 as desired to provide structural support to the integrity of the connector housing 204 during the crimping operation. Alternatively, as illustrated in FIG. 5C, the mounting portion 224, and thus the mounting plate 262 can extend out from the connector housing 204 during the stamping operation, such that the second surface 265 is braced against a support, such as a first die. The flat flex cable 22 can be placed adjacent the crimp teeth 268, for instance adjacent the tapered distal ends 268*a*, and brought against the crimp teeth 268 such that the crimp teeth 268 pierce the flat flex cable 22 and extend through the flat flex cable 22. A second die can be positioned adjacent the crimp teeth 268, such that the flat flex cable 22 and the mounting portion 224 are disposed between the first and second dies. The first and second dies can then be brought toward each other after the crimp teeth 268 have pierced through the flat flex cable 22, thereby causing the crimp teeth 268 to fold back toward the flat flex cable 22 such that the tapered distal ends 268*a* are embedded in the flat flex cable 22. The crimp teeth 268 can have any height when uncrimped as desired, it being appreciated that as the height of the crimp teeth 268 increases, the crimp teeth 268 can be crimped against the flat flex cable 22 under reduced stamping forces that are applied against the connector housing 204.

Thus, crimping the crimp teeth 268 against the flat flex cable 22 causes the electrical terminals 220 to place the complementary electrical device that is mated to the mating portions 222 of the electrical terminals 220 in electrical communication with the flat flex cable 22. The flat flex cable 22 can thus define a first end that is mounted onto mounting portions 224 of the terminals, and an opposed second end that is electrically connected to a complementary electrical device, such as a sensor or a processor. Thus, the flat flex cable 22 can place a processor in electrical communication with the mounting portions 224 of the electrical terminals 220 and the mating portions 222 can be electrically connected to a sensor. Conversely, the flat flex cable 22 can place a sensor in electrical communication with the mounting portions 224 of the electrical terminals 220 and the mating portions 222 can be electrically connected to a processor. It should be appreciated that the crimp members 267 can secure a flexible connection to a complementary electrical device, while allowing the electrical connector 202 to have a compact design while providing for ease of manufacturability.

Figures 6B, 6C:
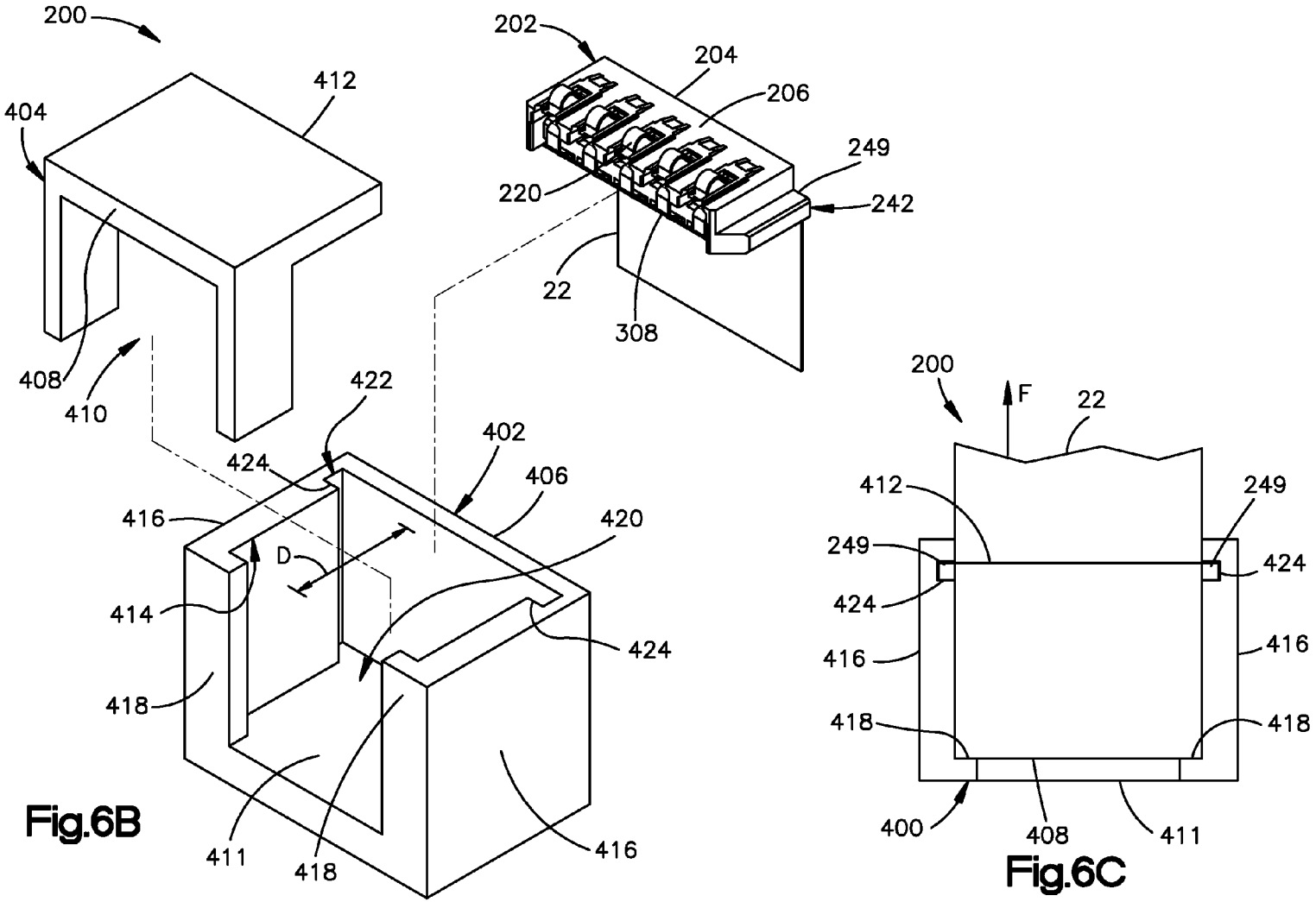
FIG. 6B is a schematic assembly view of the electrical connector assembly including a strain relief assembly configured to retain a flexible cable connector, for instance of the type illustrated in FIGS. 1 and 6A.
FIG. 6C is a top plan view of the electrical connector assembly illustrated in FIG. 6B.

Referring now to FIGS. 6B-C, it is appreciated that stresses can be placed upon the flat flex cable 22 during operation. For instance, if substantial pulling forces are applied to the flat flex cable 22, the stresses could affect the integrity of the connection between the flat flex cable 22 and the crimp teeth 268. Accordingly, the electrical connector assembly 200 can include a strain relief assembly 400 that is configured to receive the electrical connector 202. The strain relief assembly 400 includes at least one retention force member that provides a retention force against the flat flex cable 22. Accordingly, when a pulling or tensile force F is applied to the flat flex cable 22 at a location spaced from the strain relief assembly 400, and the pulling force is less than the retention force, the pulling force is absorbed by the retention force, thereby isolating the pulling force from the connection between the flat flex cable 22 and the crimp members 267.

Figure 7:
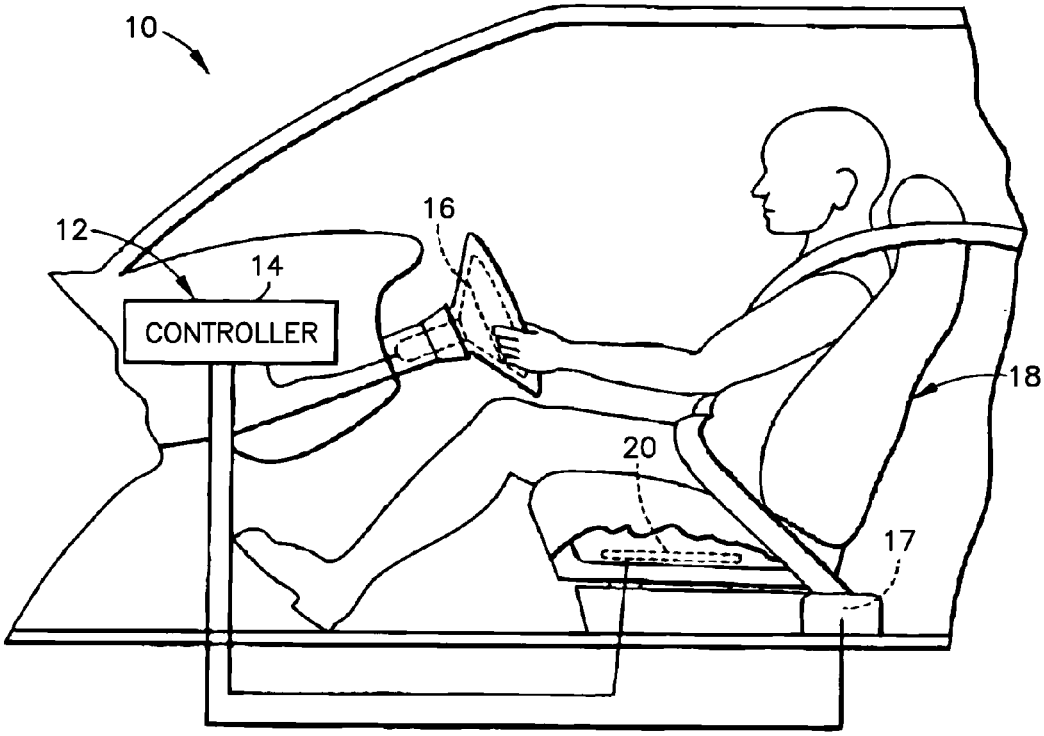
FIG. 7 is a diagrammatic view of a portion of a vehicle having a safety restraint system that includes the electrical connector assembly illustrated in FIG. 1.

The strain relief assembly 400 includes first and second complementary strain relief members 402 and 404. The first strain relief member 402 includes a first support wall 406 configured to extend parallel to and abut the bottom end 208 of the connector housing 204. When the flat flex cable 22 is mounted to the crimp members 267, the first support wall 406 can abut the flat flex cable 22 and thus be configured to compress the flat flex cable 22 against the bottom end 208. The second strain relief member 404 includes a second support wall 408 that is opposite the first support wall 406 and is configured to abut the top end 206 of the connector housing 204, such that the connector housing 204 is sandwiched between the first and second support walls 406 and 408. The strain relief assembly 400 defines a contact access window 410 that extends through the second support wall 408. The contact access window 410 can be sized so as to receive all of the mating ends 222 of the electrical terminals 220 as illustrated, or can be bifurcated so as to define individual slots that each receives a select one or more of the mating ends 222. The contact access window 410 can be enclosed, or can be open as illustrated, for instance at the lower end of the support wall 308 in the orientation as illustrated in FIG. 7.

The second support wall 408 can have a thickness less than the amount that the mating ends 222 of the electrical terminals 220 extend beyond the top end 206 of the connector housing 204, such that the mating ends 222 extend through the contact access window 410 and can mate with complementary electrical terminals of a complementary electrical connector.

The strain relief assembly 400 can further include a base 411 that extends from one or both of the support walls 406 and 408, and extends toward the opposed support wall. The base 411 is configured to support the front end 210 of the connector housing 204 as illustrated. Therefore, in accordance with the illustrated embodiment, the flat flex cable 22 extends along the bottom end 208 of the connector housing 204, and out the rear end 212. In accordance with the illustrated embodiment, the base 411 extends from the bottom of the first support wall 406 toward the second support wall 408.

The second strain relief member 404 can further include a cover 412 that directs the flat flex cable 22 in a desired direction, for instance down from the connector housing 204 in a direction angularly offset, such as substantially perpendicular, with respect to the bottom end 208 of the connector housing 204. Alternatively, the first strain relief member 402 could include a cover that directs the flat flex cable 22 up along a direction angularly offset, such as perpendicular, with respect to the front end 210 of the connector housing 204. It should be appreciated that the base 411 can alternatively support the rear end 212 of the connector housing 204 such that the flat flex cable 22 can extend out the front end 210, and can be directed as desired in the manner described above.

The strain relief assembly 400 further includes a compression assembly 414 hat can be constructed as desired so as to apply a compressive retention force onto the flat flex cable 22. In accordance with the illustrated embodiment, the compression assembly 414 includes a compression flange 416 that extends forward from opposed ends of the first support wall 406 along a direction toward the second support wall, and defines a retention lip 418 that extends inward from the distal end of the compression flange 416. The strain relief assembly 400 defines a channel 420 between the retention lip 418 and the first support wall 406 that defines a dimension D that is substantially equal to, or slightly less than, the combined thickness of the second support wall 408, the height of the electrical connector 202, and the thickness of the flat flex cable 22. Accordingly, when the electrical connector 202 is disposed between the first and second strain relief members 402 and 404, and the second support wall 408 is disposed in the channel 420, a compressive force is applied to the flat flex cable 22 between the bottom end 208 of the connector housing 204 and the first support wall 406. In accordance with the illustrated embodiment, the strain relief assembly 400 can compress the flat flex cable 22 directly against the connector housing 202. However, it should be appreciated that the strain relief assembly 400 can alternatively compress the flat flex cable 22 against the connector housing 202 indirectly, for instance via an intermediate member as desired.

Thus, a compressive retention force is applied against the flat flex cable 22 that resists a pulling force applied to the flat flex cable 22 that might otherwise affect the connection between the crimp members 267 and the flat flex cable 22. It should be appreciated that the first and second strain relief members 402 and 404 can be attached or operatively coupled in any desired manner so as to provide the compressive retention force against the flat flex cable 22. Furthermore, because the flat flex cable 22 is compressed against the connector housing 204, it should be appreciated that the strain relief assembly 400 maintains the integrity of the connection between the flat flex cable 22 and the mounting portions 224 of the electrical terminals 220, for instance, when the electrical connector 202 is subjected to heavy impact and vibration during use, and when the flat flex cable 22 is placed in tension during use.

The strain relief assembly 400 can further include an engagement member 422 configured to engage the engagement member 242 of the electrical connector 202. For instance, the engagement member 422 can be provided as opposed slots 424 that extend into the compression flange 416 and are sized to receive the guide rails 249 of the electrical connector 202. The slots 424 can be sized and/or positioned such that the second support wall 308 can compress the electrical connector 202 and flat flex cable 22 against the first support wall 406 in the manner described above. Alternatively, the electrical connector 202 can be devoid of the guide rails 249, and the compression between the first and second strain relief members 402 and 404 can retain the electrical connector in a desired position.

Referring to FIG. 7, there is shown a diagrammatic view of a portion of a vehicle 10 having a safety restraint system 12 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

A similar safety restraint system is described in U.S. Pat. Nos. 6,129,168 and 6,932,382, the disclosure of each of which is hereby incorporated by reference in its entirety. The safety restraint system 12 generally comprises a controller 14, airbags 16, 17, and a seat sensor device 20 located in a seat 18. In the embodiment shown, the air bag 16 is a steering wheel mounted air bag. The air bag 17 is a seat belt mounted air bag. The controller 14 can be connected to other air bags in the vehicle 10, such as a passenger side dashboard mounted air bag and side mounted air bags, for example. The controller 14 is connected to the air bags 16, 17 to control their deployment. The controller 14 is also connected to various sensors located about the vehicle as is generally known in the art.

One of the sensors connected to the controller 14 is the seat sensor device 20 located in the seat 18. In the embodiment shown, the seat sensor device 20 is shown in the driver's seat. One or more additional seat sensor devices could be located in one or more of the passenger seats. The seat sensor device 20 is adapted to determine the size and position of a person sitting in the seat. The information sensed by the seat sensor device 20 is transmitted back to the controller 14 to allow the controller to determine if and/or at what force the air bags 16, 17 should be deployed in the event of an accident.

Figure 8:
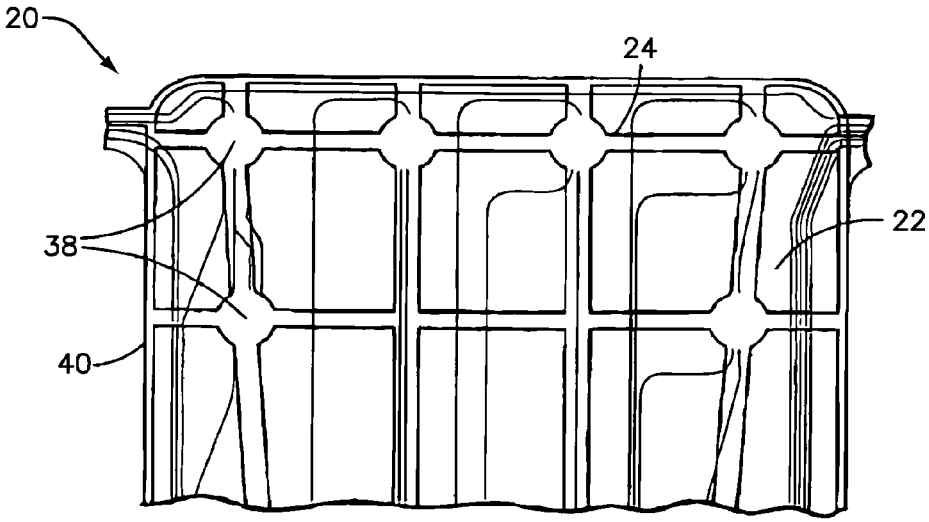
FIG. 8 is a top plan view of a seat sensor device used in the vehicle safety restraint system shown in FIG. 7.
Figure 9:
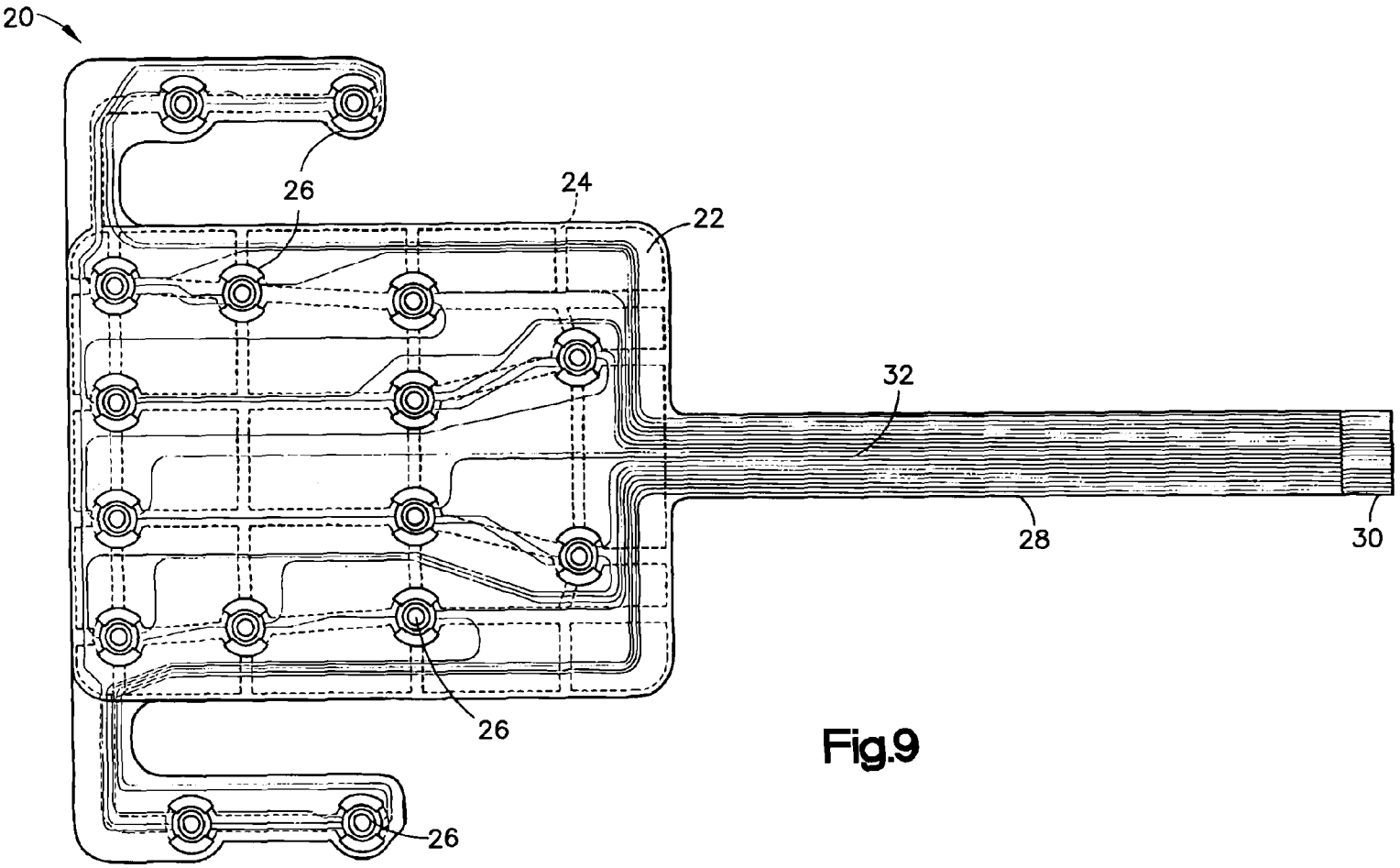
FIG. 9 is a bottom plan view of a portion of the seat sensor device shown in FIG. 8.
Figure 10:
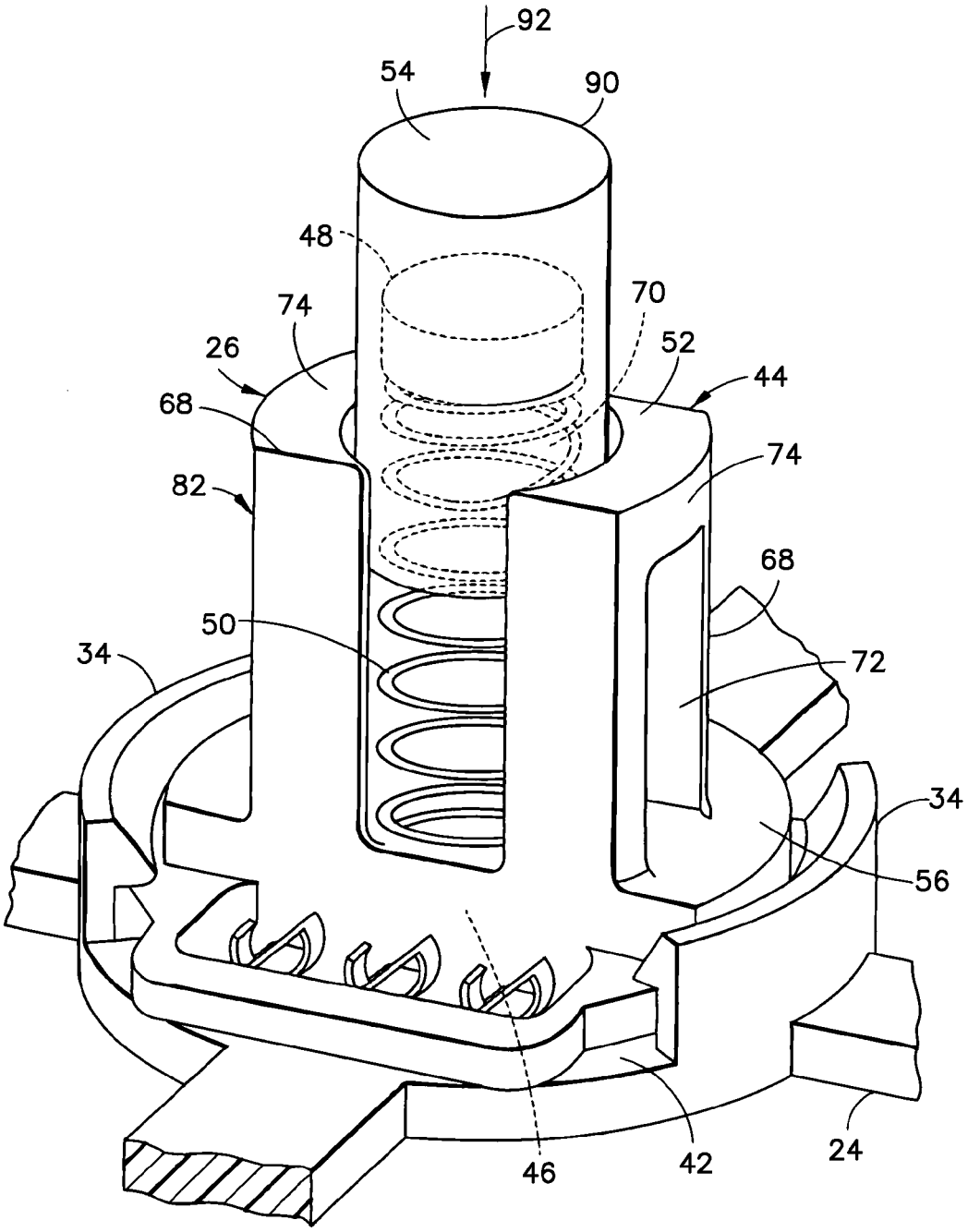
FIG. 10 is an enlarged perspective view of a portion of the seat sensor device shown in FIG. 8, but without showing the flexible printed circuit may merely for the sake of clarity.
Figure 11:
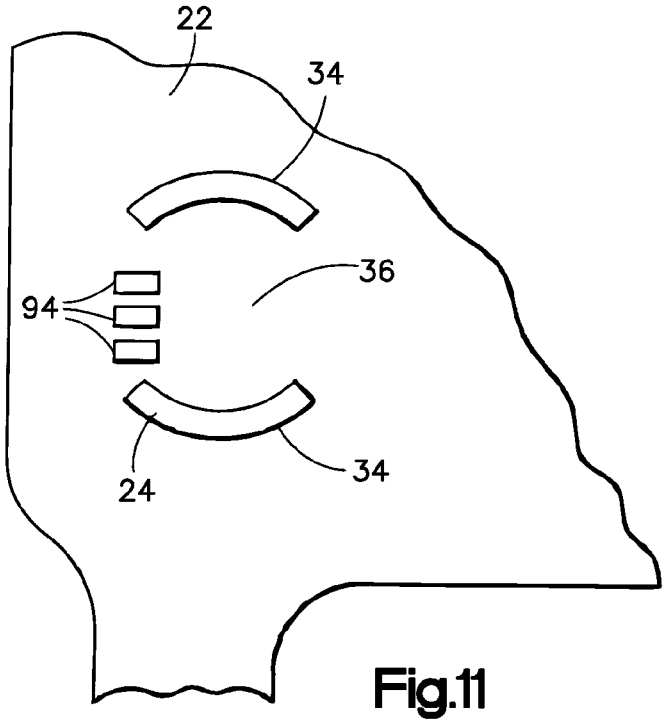
FIG. 11 is a partial top plan view of a portion of the flexible printed circuit mat, the frame, and three terminals prior to connection of a Hall effect sensor assembly.
Figure 12:
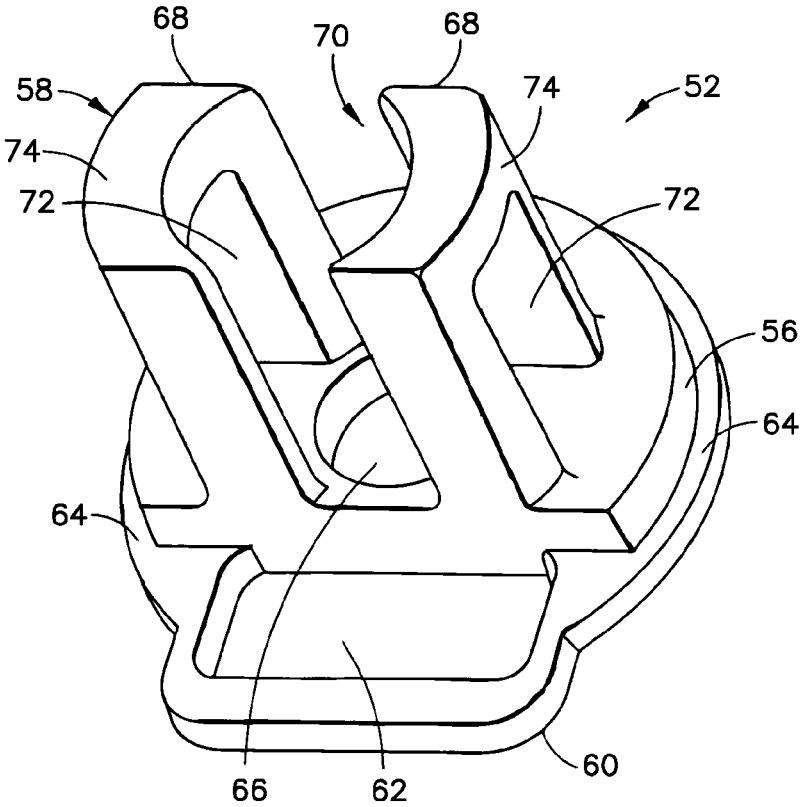
FIG. 12 is a perspective view of a first housing member of the sensor assembly shown in FIG. 10.

Referring now also to FIGS. 8-10, the seat sensor device 20 generally comprises a flat flex cable, or flexible printed circuit (FPC), 22, a frame 24, and a plurality of Hall effect sensor assemblies 26. The controller 14 can include the electrical connector 202 mounted to the flat flex cable 22 as described above, and a complementary electrical device mated to the electrical connector 202 and having a processor that receives signals from the various sensors to determine if and/or at what force the air bags 16, 17 should be deployed. As seen best in FIG. 8, the flexible printed circuit 22 is provided in the general shape of a mat. The flat flex cable mat 22 has a connection tail 28 with contact sections 30. Electrical conductors 32 extend through the flat flex cable mat 22 and are covered by electrical insulation. The frame 24 is generally comprised of molded plastic. The frame 24 provides a support for the flat flex cable mat 22. The frame 24 is located against a bottom side of the flat flex cable mat 22. As shown in FIG. 11, the frame 24 comprises pairs of snap lock latches 34 which extend through holes in the flat flex cable mat 22 such that the snap lock latches are located on the top side of the flat flex cable mat 22. Each of the opposing pairs of snap lock latches 34 form a receiving area 36 therebetween on the top side of the flat flex cable mat 22. As shown best in FIG. 9, the frame 24 comprises support sections 38 connected to each other by a support lattice section 40. The support sections 38 comprise a general flat disk shape. The snap lock latches 34 extend from a top side of the support sections 38. Thus, the support sections 38 provide a substantially flat surface 42 on the top side of the frame 24 between each of the pairs of snap lock latches 34.

Referring now particularly to FIG. 10, a portion of the frame 24 is shown with one of the Hall effect sensor assemblies 26 attached thereto. FIG. 10 shows the seat sensor device without showing the flat flex cable mat 22 merely for the sake of clarity. The flat flex cable mat 22 would be located between the flat surface 42 and the bottom side of the Hall effect sensor assembly 26. The flat flex cable mat is essentially sandwiched between the bottom side of the sensor assembly 26 and the flat surface 42. The Hall effect sensor assembly 26 generally comprises a housing 44, a Hall effect sensor 46, a magnet 48, and a spring 50. In the embodiment shown, the seat sensor device 20 comprises sixteen of the Hall effect sensor assemblies 26 (see FIG. 8). However, in alternate embodiments, the seat sensor device could comprise more or less than sixteen Hall effect sensor assemblies. In addition, the Hall effect sensor assemblies could be positioned in any suitable type of array on the flat flex cable mat 22.

Referring also to FIGS. 12-16, the housing 44 generally comprises a first housing member 52 and a second housing member 54. The first housing member 52 is preferably comprised of molded plastic or polymer material. As seen best in FIGS. 12 and 13, the first housing member 52 generally comprises a base section 56 and a general tube section 58. The base section 56 generally comprises an extension 60 having an open aperture 62, snap lock ledges 64, and a central spring cavity 66. The general tube section 58 extends in an upward direction from the top side of the base section 56 around the spring cavity 66. The general tube section 58 generally comprises two opposing curved columns 68. The two columns 68 defined a magnet movement path therebetween. More specifically, the two columns 68 define an area 70 which is adapted to receive the second housing member 54 which houses the magnet as further described below. In the embodiment shown, each of the columns 68 include an alignment slot 72 therein. The alignment slots 72 are used to movably attach the second housing member 54 to the first housing member 52 as further described below. The top sides of the alignment slots 72 are closed by transverse sections 74 of the columns.

Figure 13:
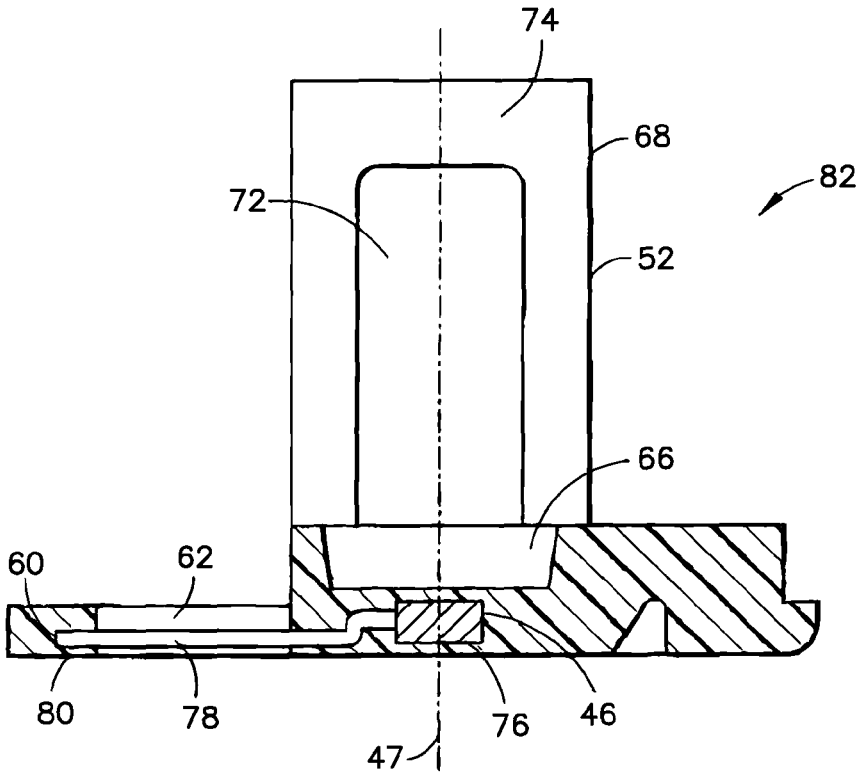
FIG. 13 is a cross sectional view of a first subassembly of the sensor assembly shown in FIG. 10 comprising the first housing member shown in FIG. 12 and a Hall effect sensor.
Figure 14:
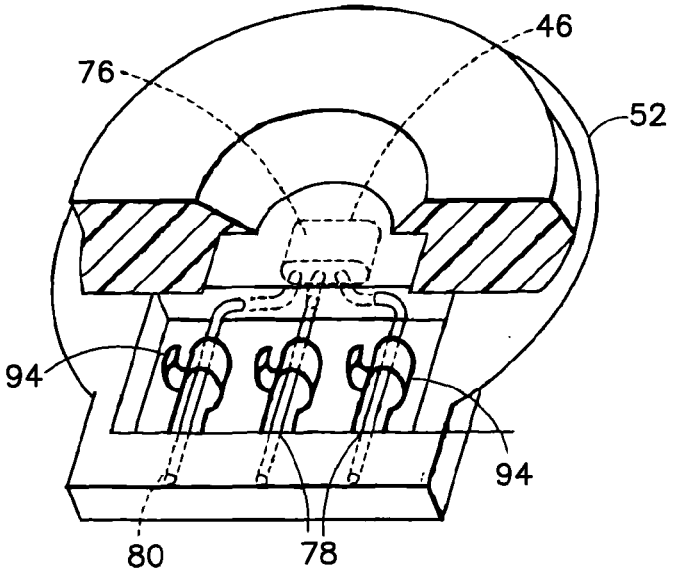
FIG. 14 is a perspective view of the first subassembly shown in FIG. 13 with a cutaway section.

Referring particularly to FIGS. 13 and 14, the Hall effect sensor 46 is housed, at least partially, inside the first housing member 52. Thus, the first housing member 52 and the Hall effect sensor 46 form a first subassembly 82. In a preferred embodiment of the present invention, the first housing member 52 comprises an overmolded housing which is overmolded over portions of the Hall effect sensor 46. The Hall effect sensor 46 generally comprises a sensing section 76 and three electrical leads 78. One lead is for power, one lead is for ground and one lead is for signals. In a preferred embodiment, the Hall effect sensor 46 is a range taking sensor capable of continuous signaling of distance of the magnet relative to the sensor 46. However, in alternate embodiments, the Hall effect sensor could be adapted to signal two or more range settings, such as by using a step capable sensor.

The three electrical leads 78 span across the open aperture 62 of the extension 60 in the first housing member 52 and, more specifically, the electrical leads 78 comprises exposed middle sections which do not have the overmolded housing member 52 thereon. The electrical leads 78 comprise distal ends 80 which are fixedly attached to the first housing member 52 by the overmolding process. The proximal end of the electrical leads 78 are also fixedly attached to the first housing member by the overmolding process. Thus, the first housing member 52 retains the exposed middle sections of the electrical leads in a fixed, spaced orientation relative to each other and a fixed orientation relative to the overmolded housing member 52.

Figure 15:
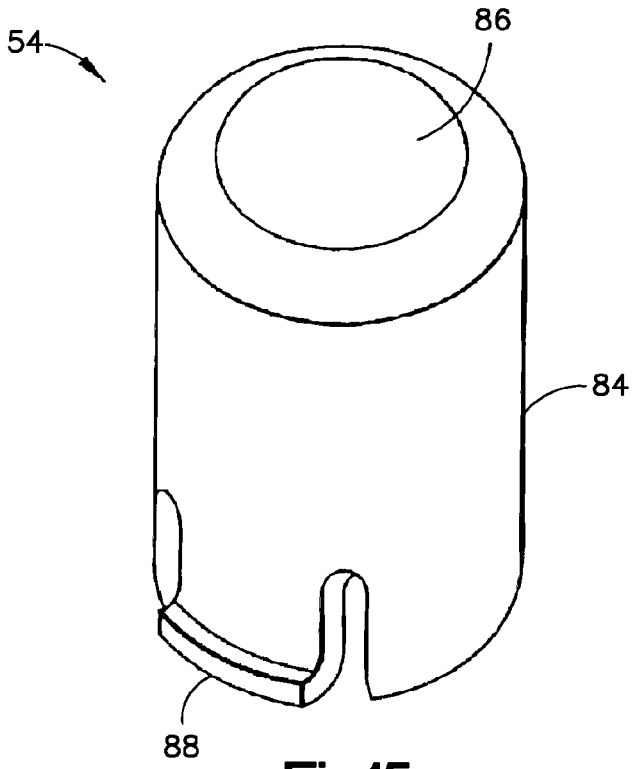
FIG. 15 is a perspective view of a second housing member used in the sensor assembly shown in FIG. 10.
Figure 16:
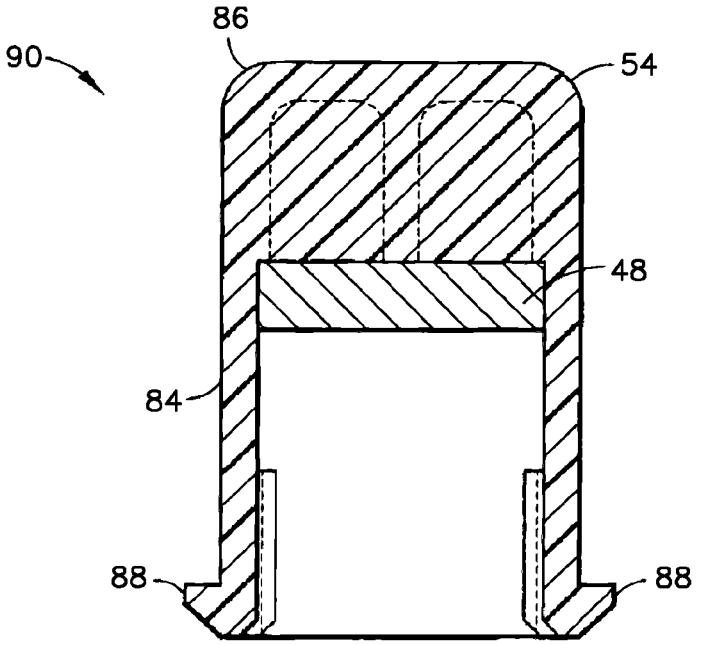
FIG. 16 is a cross sectional view of a second subassembly used in the sensor assembly shown in FIG. 10 comprising the second housing member shown in FIG. 15 and a permanent magnet.

Referring particularly to FIGS. 15 and 16, the second housing member 54 generally comprises a one-piece member preferably comprised of molded plastic or polymer material. The second housing member 54 generally comprises a tube shaped section 84, a top section 86 and snap lock latches 88 forming a bottom part of the tube shaped section 84. The magnet 48 is located inside the tube shaped section 84 against the bottom side of the top section 86. The magnet 84 is preferably press fit inserted into the second housing member. Thus, the second housing member 54 and magnet 48 form a second subassembly 90.

As seen in FIG. 10, the spring 50 is connected between the two subassemblies 82, 90. A first end of the spring 50 is located in the spring cavity 66 of the first housing member 52 (see FIG. 12) and a second opposite end of the spring is located inside the tube shaped section 84 of the second housing member 54. The second opposite end of the spring 50 is located directly against the bottom side of the magnet 48. The spring 50 biases the second subassembly 90 in an upward direction as shown in FIG. 10. In a preferred embodiment the spring is comprised of nonferrous material such that it does not impact the magnetic field.

In order to assemble the two subassemblies 82, 90 and spring 50 together, the spring is placed in the spring cavity 66 and the second subassembly 90 is inserted into the top of the first subassembly 82 as indicated by arrow 92 with the bottom of the second housing 54 entering into the area 70 between the two columns 68. The area 70 is sized and shaped to slidably receive the second housing member 54 therein. As the second housing member 54 is inserted into the area 70, the snap lock latches 88 are resiliently deflected in an inward direction until the latches pass by the transverse sections 74 of the columns 68. The snap lock latches 88 are then able to deflect outward and into the two alignment slots 72. This provides a snap lock connection of the second housing member 54 to the first housing member 52.

Figure 17:
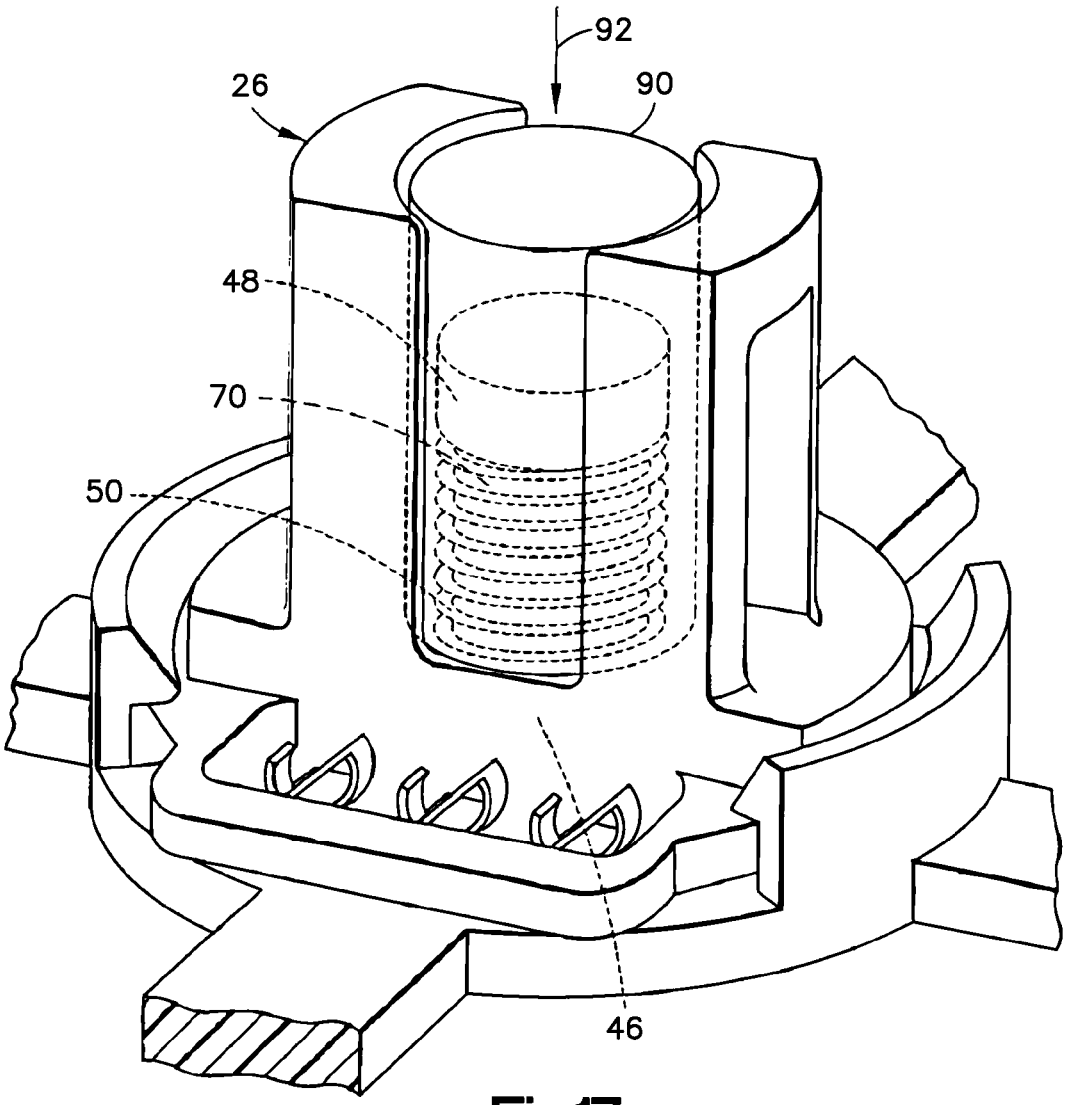
FIG. 17 is a perspective view as in FIG. 10 with the second subassembly moved towards a depressed position.

The snap lock connection merely prevents the second subassembly 90 from becoming disengaged from the first subassembly 82. However, the connection of the two subassemblies 82, 90 to each other provides a movable connection. More specifically, the outer portions of the snap lock latches 88 are adapted to vertically slide in the alignment slots 72. Referring also to FIG. 17, the Hall effect sensor assembly 26 is shown similar to that shown in FIG. 10, but in this configuration the second subassembly 90 has been depressed as indicated by arrow 92 in an inward direction; further into the area 70. This results in the spring 50 being resiliently compressed and the magnet 48 being moved closer to the Hall effect sensor 46. When force is reduced on the top surface of the second subassembly 90, the spring 50 can move the second subassembly and the magnet 48 in a direction away from the Hall effect sensor 46. With the present invention, the movably connection between the two housing members 52, 54 provides a telescoping type of movement which allows the magnet to move towards and away from the Hall effect sensor 46 along a Hall effect central sensing axis 47 (see FIG. 13). The movable connection is designed to prevent the magnet 48 from getting out of parallel with the Hall effect sensor 46 by more than ten degrees. In a preferred embodiment, the magnet might only be able to tilt or move out of alignment by 5-10 degrees.

Figure 18:
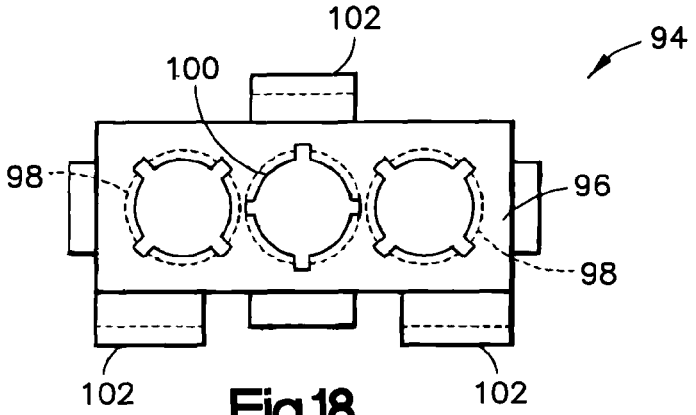
FIG. 18 is a top plan view of one of the terminals used to connect the sensor assembly shown in FIG. 10 to the flexible printed circuit mat.
Figure 19:
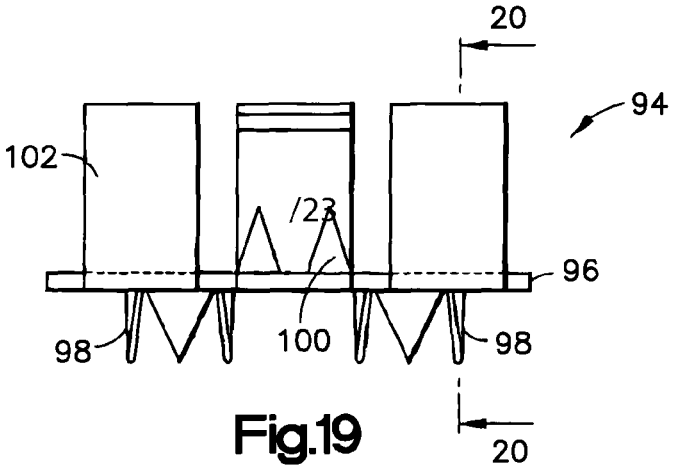
FIG. 19 is a side elevation view of the terminal shown in FIG. 18.
Figure 20:
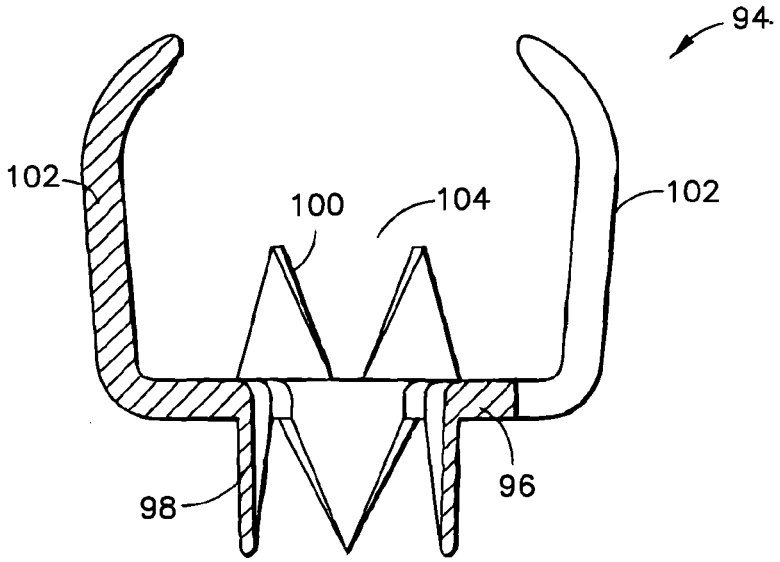
FIG. 20 is a cross sectional view of the terminal shown in FIG. 19 taken along line 20-20.
Figure 21:
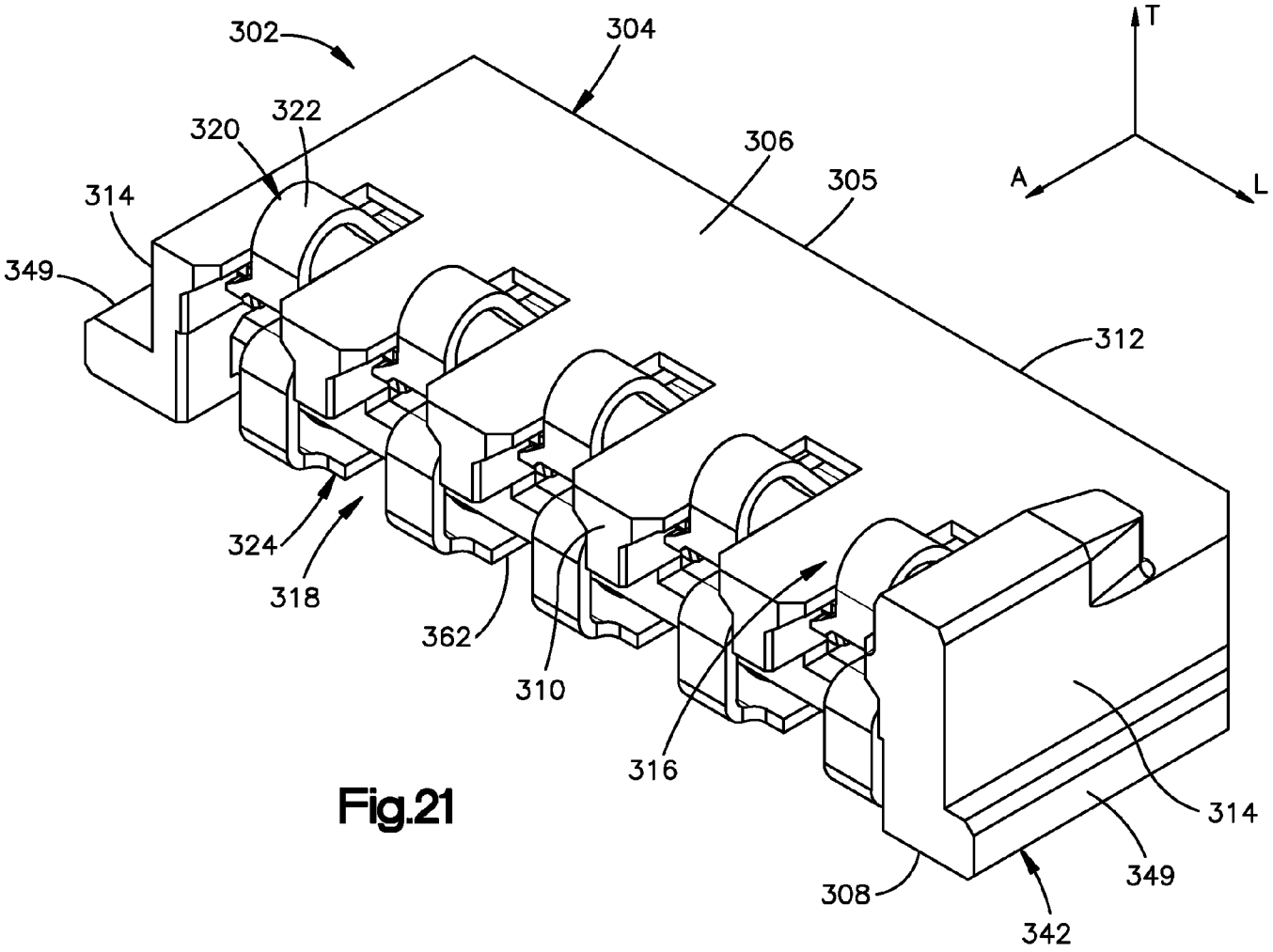
FIG. 21 is a perspective view of an electrical connector similar to the electrical connector illustrated in FIG. 2A, but including electrical contacts having inwardly-facing crimp members.

As seen best in FIGS. 11 and 14F, the seat sensor device 20 includes electrical terminals 94. More specifically, in the embodiment shown, three of the terminals 94 are provided at each of the sensor assemblies 26; one terminal for each one of the electrical leads 78 of the Hall effect sensor 46. Referring also to FIGS. 18-20, one of the terminals 94 is shown. Each terminal 94 generally comprises a one-piece electrically conductive member. In a preferred embodiment, the terminal 94 is comprised of flat sheet metal which has been stamped into the shape shown. The terminal 94 generally comprises a center section 96, bottom extending sections 98, a top extending section 100, and upward extending side sections 102.

The terminals 94 are fixedly attached to the flat flex cable mat 22 before the sensor assemblies 26 are connected. More specifically, the terminals 94 are pressed against the top surface of the flat flex cable mat 22 with the bottom extending sections 98 piercing through the mat and being deformed outward and upward to form a mechanical and electrical connection with individual ones of the electrical conductors 32 in the mat. When the sensor assemblies 26 are being connected to the flat flex cable mat 22 and the snap lock latches 34 of the frame 24, the terminals 94 are received in the open aperture 62 of the extension 60 through the bottom of the first housing member 52. The electrical leads 78 of the Hall effect sensors 46 are each positioned into the area 104 between the side sections 102 of one of the terminals.

The side sections 102 are then deformed inward towards the area 104 to clamp the middle exposed sections of the electrical leads 78 into a mechanical and electrical connection with the top extending section 100 and side sections 102 against the top side of the center section 96. If the electrical leads 78 comprise electrical insulation, the relatively sharp edges on the top extending section 100 is adapted to cut through the electrical insulation to insurer electrical contact between the terminal 94 and the electrical conductor of the electrical lead 78. However, in alternate embodiments, any suitable type of terminal or method of electrically connecting the electrical leads 78 to the electrical conductors 32 of the flat flex cable mat 22 could be provided. However, in the embodiment shown, the terminals 94 are adapted to allow the side sections 102 to be moved to an open position again to allow the sensor assembly 26 to be removed from connection with the terminals. A replacement sensor assembly can be connected to the flat flex cable mat to replace a broken or faulty original sensor assembly 26. Thus, in a preferred embodiment, the electrical connection of the sensor assembly 26 to the conductors in the flat flex cable mat is preferably a removable connection. In an alternate embodiment, the electrical connection might not comprise a removable connection.

Referring back to FIG. 10, the sensor assembly 26 is attached to the frame 24 by inserting the base section 56 through the top side of an opposing pair of the snap lock latches 34. The snap lock ledges 64 (see FIG. 12) of the first housing member 52 snap beneath portions of the snap lock latches 34. The present invention, unlike conventional designs, does not need a separate lock to attach the frame to the flat flex cable mat. With the present invention, the first housing member 52 functions as the lock to attach the flat flex cable mat to the frame 24. The use of the first housing member 52 as the lock allows the seat sensor device 20 to be manufactured with less components. The assembly of the seat sensor device 20 comprises less steps and is therefore quicker to assemble.

Referring now to FIGS. 21-23B, the electrical connector assembly 200 illustrated in FIG. 1 can include an electrical connector 302 that is constructed substantially as described above with respect to the electrical connector 202, but includes electrical terminals 320 constructed in accordance with an alternative embodiment that each defines a mating portion 322 and an opposed mounting portion 324. For instance, while the crimp members 267 of the electrical connector 202 are oriented such that the crimp teeth 268 extend transversely outward away from the mating portion 222 as illustrated in FIG. 4, the electrical terminals 320 of the electrical connector 302 include crimp members 367 that are oriented such that the crimp teeth 268 extend transversely inward toward the mating portion 322.

In accordance with the illustrated embodiment, the electrical connector 302 includes a connector housing 304 that is dielectric or electrically insulative. The connector housing 304 includes a substantially rectangular housing body 305 that defines a top end 306, an opposed bottom end 308, a front end 310, an opposed rear end 312, and opposed sides 314. The opposed sides 314 are spaced apart along a longitudinal direction L, the front end rear ends 310 and 312 are spaced apart along a lateral direction A that is substantially perpendicular with respect to the longitudinal direction L, and the top and bottom ends 306 and 308 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the electrical connector 302 may vary during use. In accordance with the illustrated embodiment, the connector housing 304 is illustrated as elongate in the longitudinal direction.

The connector housing 304 defines a mating interface 316 disposed proximate to the top end 306, and a mounting interface 318 disposed proximate to the bottom end 308. The mounting interface 318 is configured to operatively engage a flat flex cable such as the flat flex cable 22 illustrated in FIG. 1, while the mating interface 316 is configured to operatively engage a second complementary electrical connector.

The electrical connector 302 includes a plurality of electrical terminals 320 that are electrically conductive and retained by the connector housing 304. The electrical connector 302 can include any number of electrical terminals 320 as desired. The electrical terminals 320 each define a mating portion 322 disposed proximate to the mating interface 316, and an opposed mounting portion 324 disposed proximate to the mounting interface 318. In particular, the mating portions 322 extend substantially laterally along the top end 306, and the mounting portions 324 of the electrical terminals 320 extend substantially laterally along the bottom end 308. The connector housing 304 can include a plurality of contact alignment and retention members that are carried by the housing body 305 in the manner described above with respect to FIGS. 3A-B.

The connector housing 304 can further include at least one engagement member 342 that is configured to engage a complementary engagement member of a complementary apparatus that facilitates mating of the electrical connector 302 with a complementary electrical device. The engagement member 342 can include a pair of guide rails 349 that extend laterally out from the sides 314 of the connector housing 304, and are elongate between the front and rear ends 310 and 312. Thus, it should be appreciated that the electrical connector 302 is illustrated in accordance with one embodiment, and the electrical connector 302 could be constructed in accordance with numerous embodiments so as to electrically connect a pair of complementary electrical devices.

Each of the electrical terminals 320 defines a mating portion 322 and a mounting portion 324, and an intermediate portion 350 connected between the mating portion 322 and the mounting portion 324. In accordance with the illustrated embodiment, the intermediate portion 350 is illustrated as a leg that extends vertically and defines a first or top end 350*a*, and an opposed second or bottom end 350*b*. The mating portion 322 extends from the top end 350*a*, and the mounting portion 324 extends from the bottom end 350*b*.

In accordance with the illustrated embodiment, the mating portion 322 includes an arm 352 that defines a proximal region 352*a*, a distal region 352*c*, and a flexible intermediate bent region 352*b* that is connected between the proximal region 352*a* and the distal region 352*c*. The proximal region 352*a* extends laterally rearward from the top end 350*a* of the intermediate portion 350 in a direction angularly offset from the intermediate portion 350. As illustrated, the proximal region 352*a* of the mating portion 322 extends substantially perpendicular with respect to the intermediate portion 350. The intermediate region 352*b* defines a substantially u-shaped bend of substantially 180° from the rear end of the proximal region 352*a*. Accordingly, the distal region 352*c* extends forward from the intermediate region 352*b* along a direction substantially parallel to the proximal region 352*a* to an elbow 354, and a contact portion 356 that extends forward and transversely out from the elbow 354. The contact portion 356 is illustrated as substantially hook-shaped and defines a contact surface 358 and a distal end 360 that extends down from the contact surface 358 toward the intermediate portion 350. The distal end 360 can be substantially vertically aligned with the intermediate portion 350 as illustrated, or inwardly spaced (e.g., recessed) with respect to the intermediate portion 350 as desired.

The mounting portion 324 is illustrated as including a mounting member that can be configured as a substantially planar mounting plate 362 that extends laterally rearward from the bottom end 350*b* of the intermediate portion 350 in a direction angularly offset from the intermediate portion 350. As illustrated, the mounting plate 362 extends substantially flat in the horizontal plane, along a direction substantially perpendicular with respect to the intermediate portion 350 and substantially parallel to the proximal region 352*a* of the mating portion 322. The mounting plate 362 defines an outer transverse or lower contact surface 364, and an opposed inner transverse or upper surface 365. The mounting plate 362 can have a transverse thickness greater than a remaining portion of the electrical terminal 320, or can have a substantially constant thickness with respect to the remaining portion of the electrical terminal 320.

The mounting portion 324 further includes at least one crimp member 367, such as a pair of laterally spaced crimp members 367, carried by the mounting plate 362. The crimp teeth 368 can define a tapered distal end 368*a*, and extend from the contact surface 364 to the tapered distal end 368*a* in accordance with the illustrated embodiment. The electrical terminals 320 are be constructed as described above with respect to the electrical terminals 220, with the exception that the crimp members 367 extend up from the contact surface 364 toward the respective tapered distal ends 368*a* along a direction toward the mating portion 322 so as to be disposed in a recess 355 disposed between the mounting plate 362 and the retention arm 352. Thus, each crimp member 367 can extend from the mounting plate 362, for instance from the contact surface 364, along a direction that is substantially parallel to the direction in which the mating portion 322 is spaced from the mounting portion 324. For instance, each crimp member 367 can extend from the mounting plate 362 along a direction toward the mating portion 322, and thus toward the proximal and distal regions 352*a* and 352*c*, and thus further toward the contact surface 358. The proximal region 352*a* can be disposed between the distal region 352*c* and the mounting plate 362, and thus between the distal region 352*c* and the crimp members 367.

During operation, at least one of the electrical terminals 320 up to all of the electrical terminals 320 can be configured so as to provide a spring force that has a directional component substantially normal to the contact surface 358 at the mating portion 322. For instance, the contact surface 358 can be brought into mechanical and electrical contact with a complementary electrical terminal such that the mating portion 322 is placed in compression, thereby reliably mating the mating portion 322 to the complementary electrical terminal. For instance, when the contact surface 358, and thus the distal region 352*c*, receives a force in the transverse direction T toward the proximal region 352*a* and thus toward the mounting portion 324 (for instance applied by the complementary electrical terminal), the intermediate bent region 352*b* flexes such that the distal region 352*c* compresses along the transverse direction T toward the proximal region 352*a*, and thus toward the mounting portion 324. When the crimp members 367 extend from the mounting plate 362 along a direction toward the mating portion 322, and thus toward the proximal and distal regions 352*a* and 352*c*, and thus further toward the contact surface 358, then the proximal region 352*a* flexes along a direction substantially opposite a direction from which the crimp members 367 extend from the mounting plate 362.

As described above, the connector housing 304 includes a first housing surface that can define the top end 306 of the connector housing 304, and a second housing surface that can define the bottom end 308 of the connector housing 304. A first one of the first and second housing surfaces, for instance at the top end 306, is configured to mate with a complementary connector, and the opposed second housing surface, for instance at the bottom end 308, is configured to secure the flat flex cable 22. The electrical terminals 320 define respective mating portions 322 that face outwardly from the first housing surface along a first direction, and the crimp teeth 368 face outwardly from the second housing surface along a second direction that is substantially the same as, and thus coincident with, the first direction. The electrical terminals 320 define respective mating portions 322 that face outwardly from the first surface, and the crimp teeth 368 face outwardly from the second surface. Furthermore, the electrical terminal 320 defines first and second opposed surfaces, for instance at the mating portion 322 of the electrical terminal 320 and at the mounting portion 324 of the electrical terminal 320. A first one of the opposed surfaces, for instance at the mating portion 322, is configured to mate with a complementary connector, and the opposed second surface, for instance at the mounting portion 324, is configured to secure the flat flex cable 22. The first surface can face a first direction, and the crimp teeth 368 face and can extend outwardly from the second surface along a second direction that is substantially coincident with the first direction.

As illustrated, the crimp teeth 368 can be stamped or otherwise cut from the mounting plate 362 so as to produce an aperture 370 that extends transversely through the mounting plate 362. Alternatively, the crimp teeth 368 can be discretely attached (e.g., welded) to the mounting plate 362. Each crimp member 367 includes four crimp teeth 368 that are equidistantly spaced from each other about a transverse aperture 370 that extends through the mounting plate 362. The crimp teeth 368 are arranged such that each crimp member 367 resembles the shape of a star in accordance with the illustrated embodiment. It should be appreciated, however, that each crimp member 367 can include any number of crimp teeth 368, such as at least one crimp tooth 368, that are spaced equidistantly or variably from each other.

Furthermore, each electrical terminal 320 can include at least one retention member configured to secure the electrical terminals 320 to the connector housing 304. For instance, the retention member can include a first group of one or more tangs 372 that protrude laterally outward, for instance from the proximal regions 352*a* of the retention arm 352. The retention member can further include a projection 373 that extends out from the proximal regions 352*a* at a location rearward with respect to the tangs 372. The projections 373 can extend laterally outward to a location that is recessed with respect to that of the tangs 372. The retention member can further include a second group of one or more tangs 372 that protrude obliquely out from the distal end 360 of the contact portion 356. While the electrical terminal 320 has been described in accordance with the illustrated embodiment, it should be appreciated that the electrical terminals 320 can assume any suitable alternative size and shape as desired.

The crimp teeth 368 can be secured to a flexible printed circuit in the manner described above. For instance, the flexible printed circuit can be placed against the crimp teeth 268 such that the crimp teeth 268 pierce through the flexible printed circuit. Next, the bottom surface of the mounting plate 362 can be stamped with a die, which causes the crimp teeth 268 to fold back against the connector housing 304 such that the tapered distal ends 268*a* pierce the flexible printed circuit and contact the traces running therethrough. The stamping operation can cause the crimp teeth 268 to fold outward or inward as desired.

In order to reduce the crimp forces applied to the connector housing 304 during the stamping operation, the connector housing 304 can be reinforced with a plate or any suitable structure, such as a reinforcement tool that can provide structural support to the integrity of the connector housing 304 during the crimping operation. The crimp teeth 368 can have any height when uncrimped as desired, it being appreciated that as the height of the crimp teeth 368 increases, the crimp teeth 368 can be crimped against the flexible printed circuit under reduced stamping forces that are applied against the connector housing 304.

Figure 22:
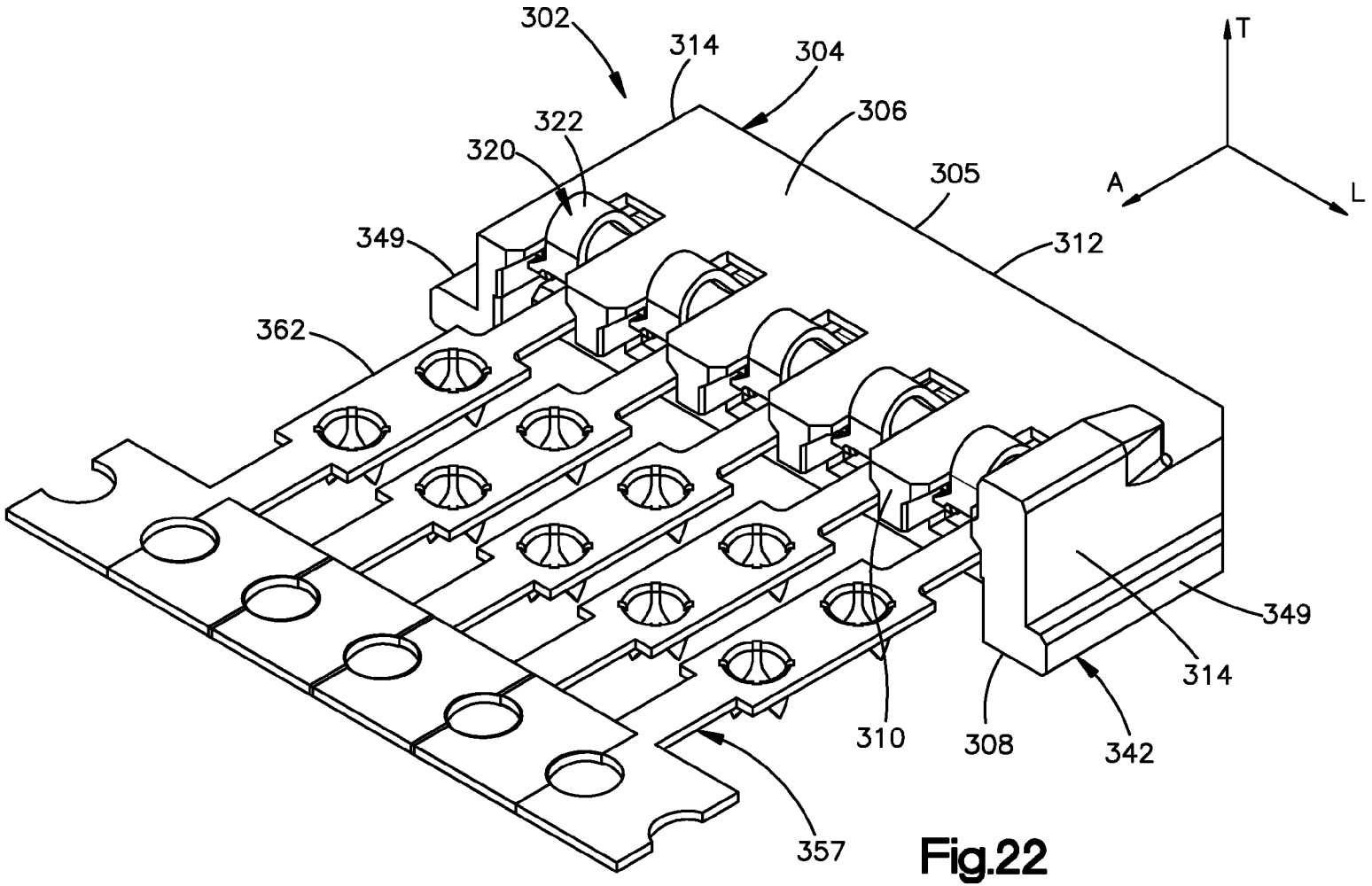
FIG. 22 is a perspective view of the electrical connector illustrated in FIG. 21, showing the electrical contacts in an unbent configuration during assembly.

Referring to FIG. 22, the electrical terminals 320 can be mounted onto the connector housing 304 along a rearward mounting direction 321 such that the respective mating portions 322 are mounted in the connector housing 304. Excess material 357 created during manufacturing of the electrical terminals 320 can be removed from the electrical terminals 320, and the electrical terminals 320 can be bent to the shape illustrated in FIG. 23B. Once the electrical terminals 320 have been installed on the connector housing 304, the mating portions 322 of the terminals 320 are configured to be placed in electrical communication with a complementary electrical device, which can be any device as desired such as a sensor or processor, or can alternatively be a complementary electrical connector, which is in turn electrically connected to another electrical device, such as a sensor or processor. The mating portions 322 can be compliant, so as to be spring biased in contact with complementary electrical terminals of the complementary electrical device.

Figure 23A:
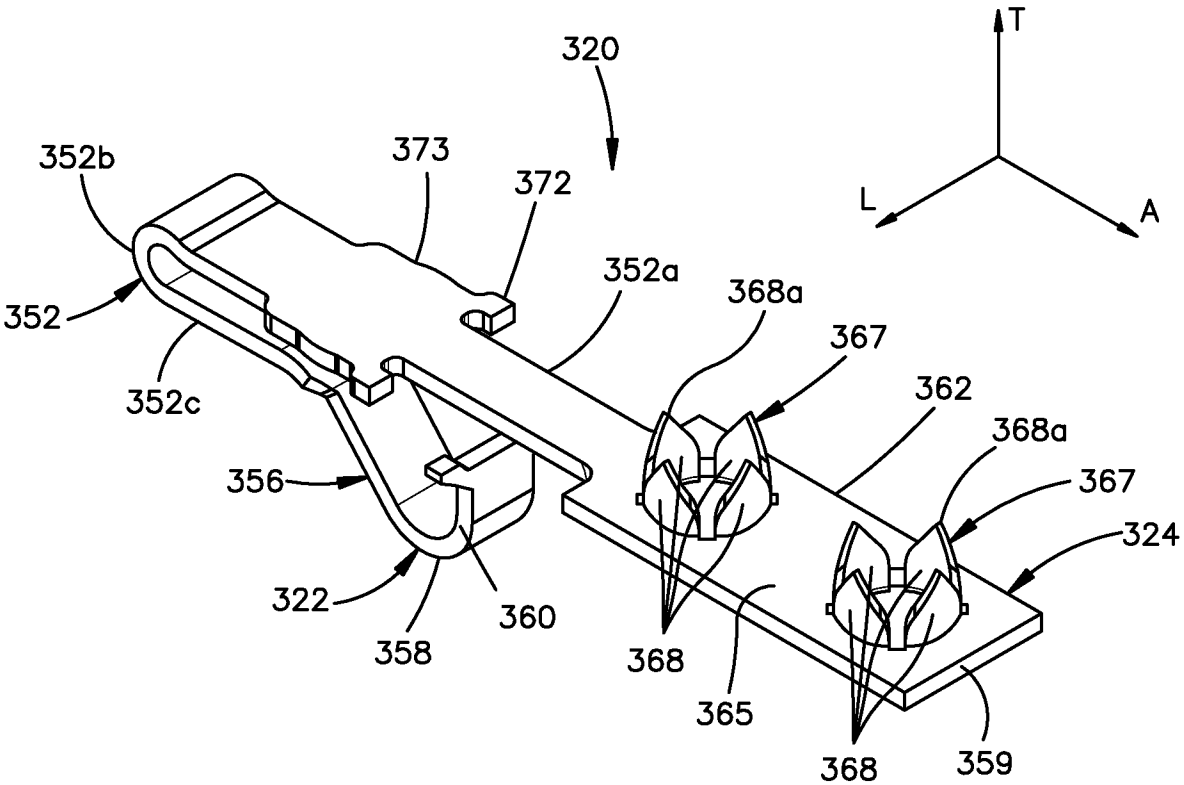
FIG. 23A is a perspective view of one of the electrical contacts illustrated in FIG. 22.
Figure 23B:
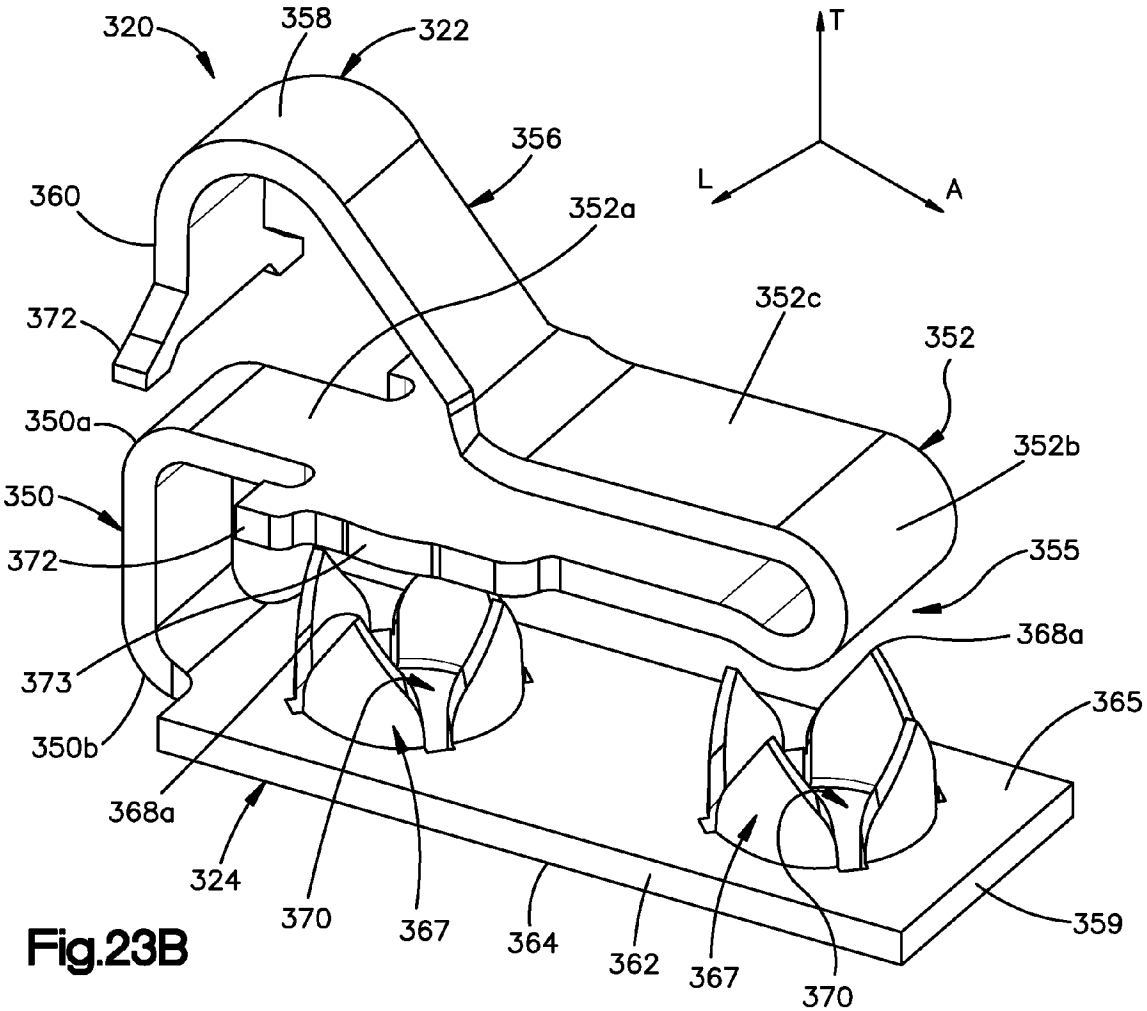
FIG. 23B is a perspective view of the electrical contact illustrated in FIG. 23, shown as assembled in the electrical connector illustrated in FIG. 21.
Figure 24:
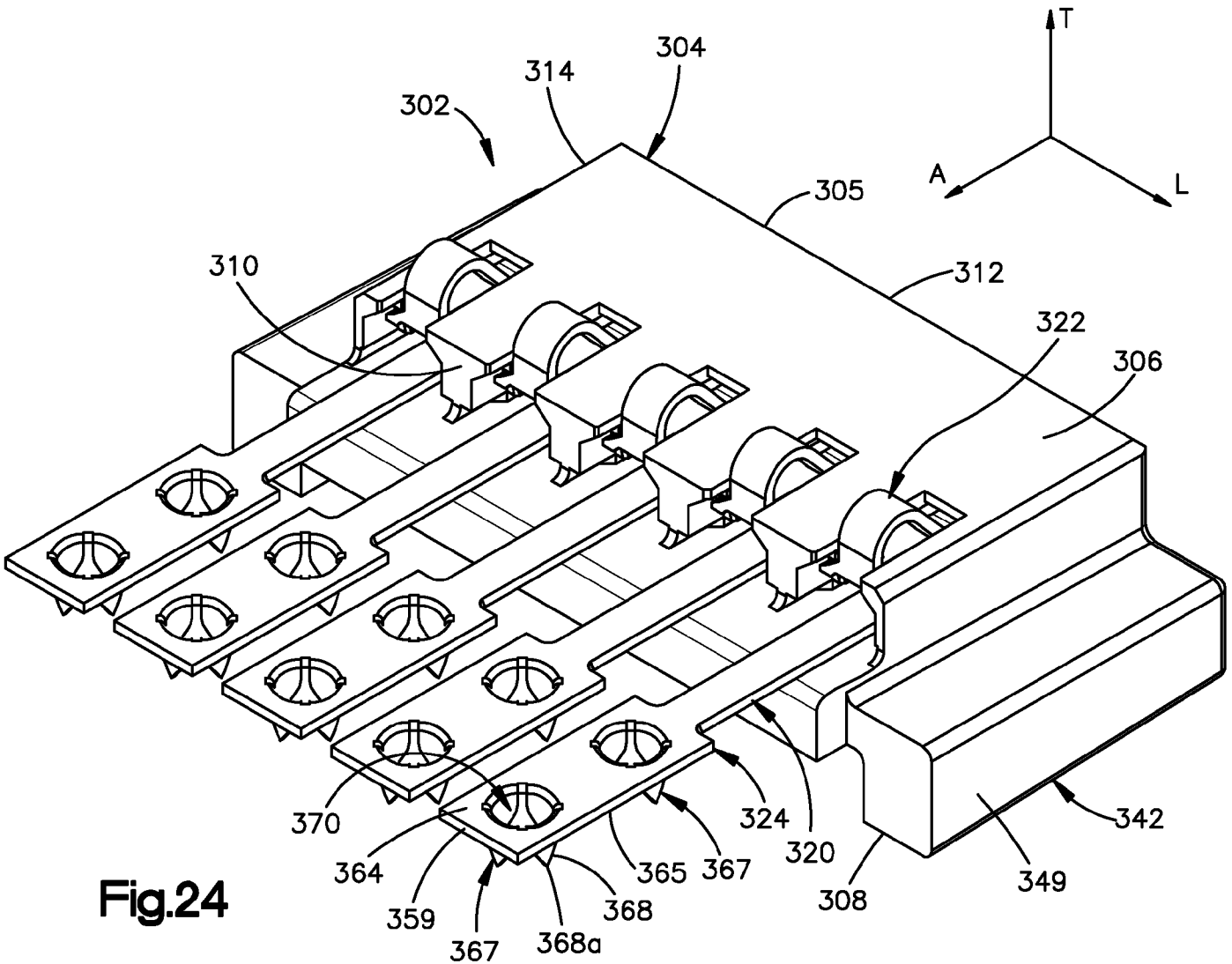
FIG. 24 is a perspective view of an electrical connector similar to the electrical connector illustrated in FIG. 21, but constructed in accordance with an alternative embodiment.
Figure 25:
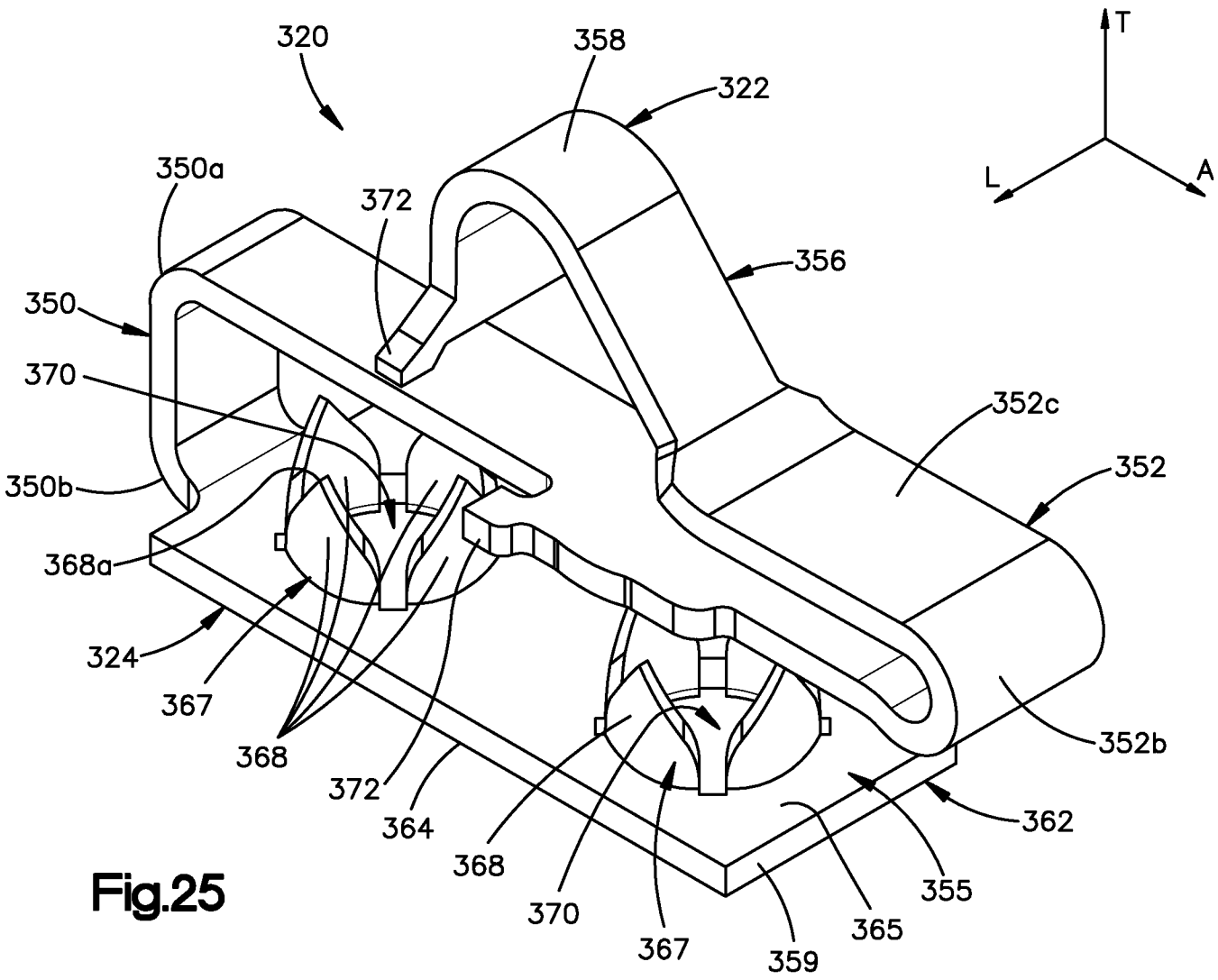
FIG. 25 is a perspective view of one of the electrical contacts of the electrical connector illustrated in FIG. 24.

It is appreciated that while the electrical terminals 220 and 320 have been described in accordance with certain embodiments, they can alternatively be constructed in accordance with any suitable embodiment as desired, unless otherwise indicated. For instance, as illustrated in FIGS. 4 and 23B, the intermediate region 252*b* and 352*b* of the electrical terminals 220 and 320, respectively, can be disposed laterally inward (or recessed) with respect to the distal ends 259 and 359 of the mounting plates 262 and 362, respectively. Alternatively, the intermediate regions 252*b* and 352*b* can be disposed in substantial alignment with the distal ends 259 and 359. Alternatively, still, the intermediate regions 252*b* and 352*b* can be disposed laterally outboard or distal with respect to the distal ends 259 and 359, thereby increasing the lateral dimension of the respective electrical terminals 220 and 320. For instance, referring to FIGS. 24-25, the intermediate region 352*b* of the electrical terminal 320 is illustrated as extending outboard or distal with respect to the distal end 359 of the mounting plate 362. Thus, it can be said that the mating end 322 extends beyond the mounting end 324 in the lateral direction. Accordingly, and electrical connector can be constructed such that the connector housing defines any suitable lateral dimension as desired so as to accommodate the lateral dimension of the electrical contacts mounted in the housing.

Figure 26A:
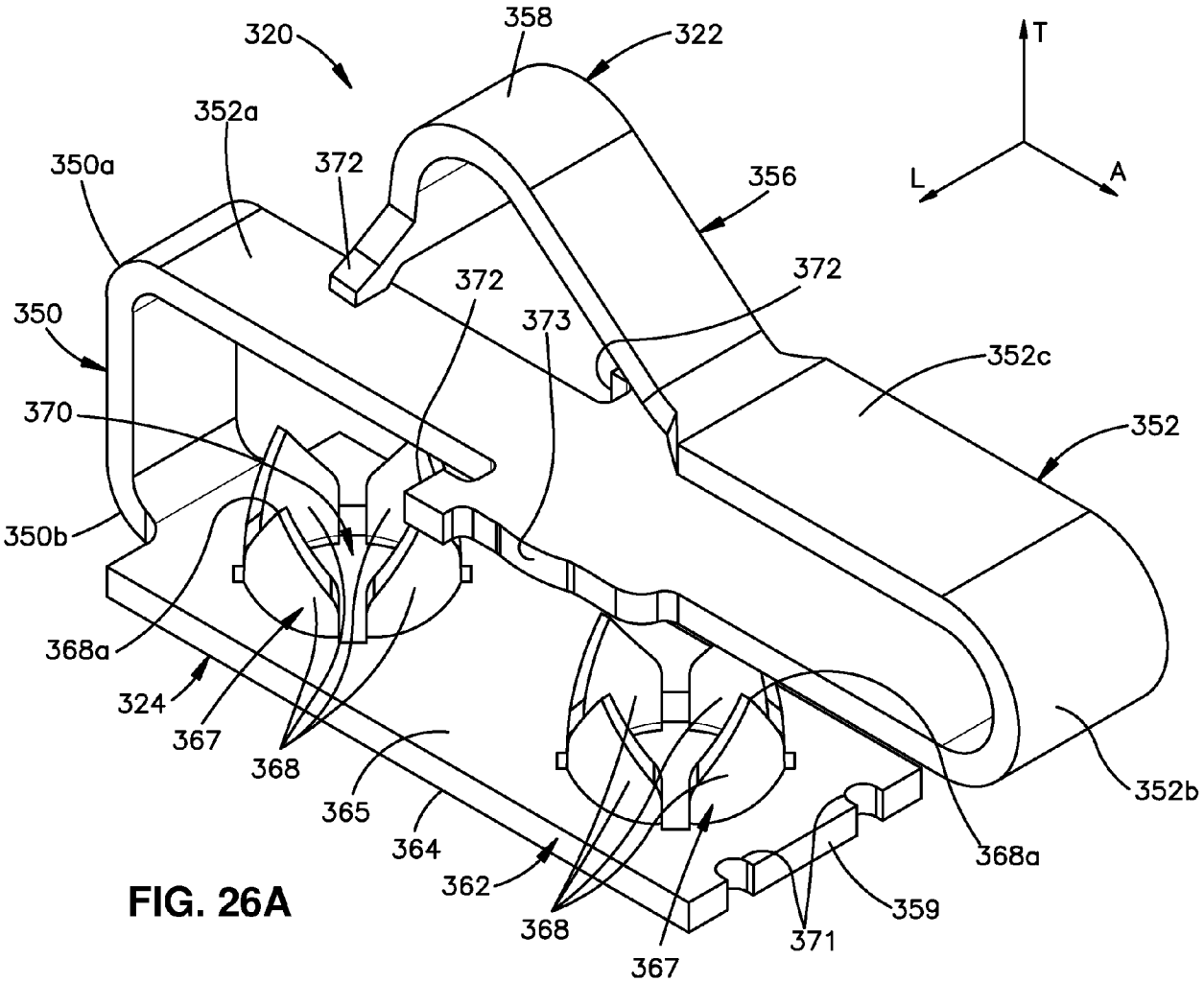
FIG. 26A is a perspective vie w of an electrical contact similar to the electrical contact illustrated in FIG. 25, but constructed in accordance with an alternative embodiment.
Figure 26B:
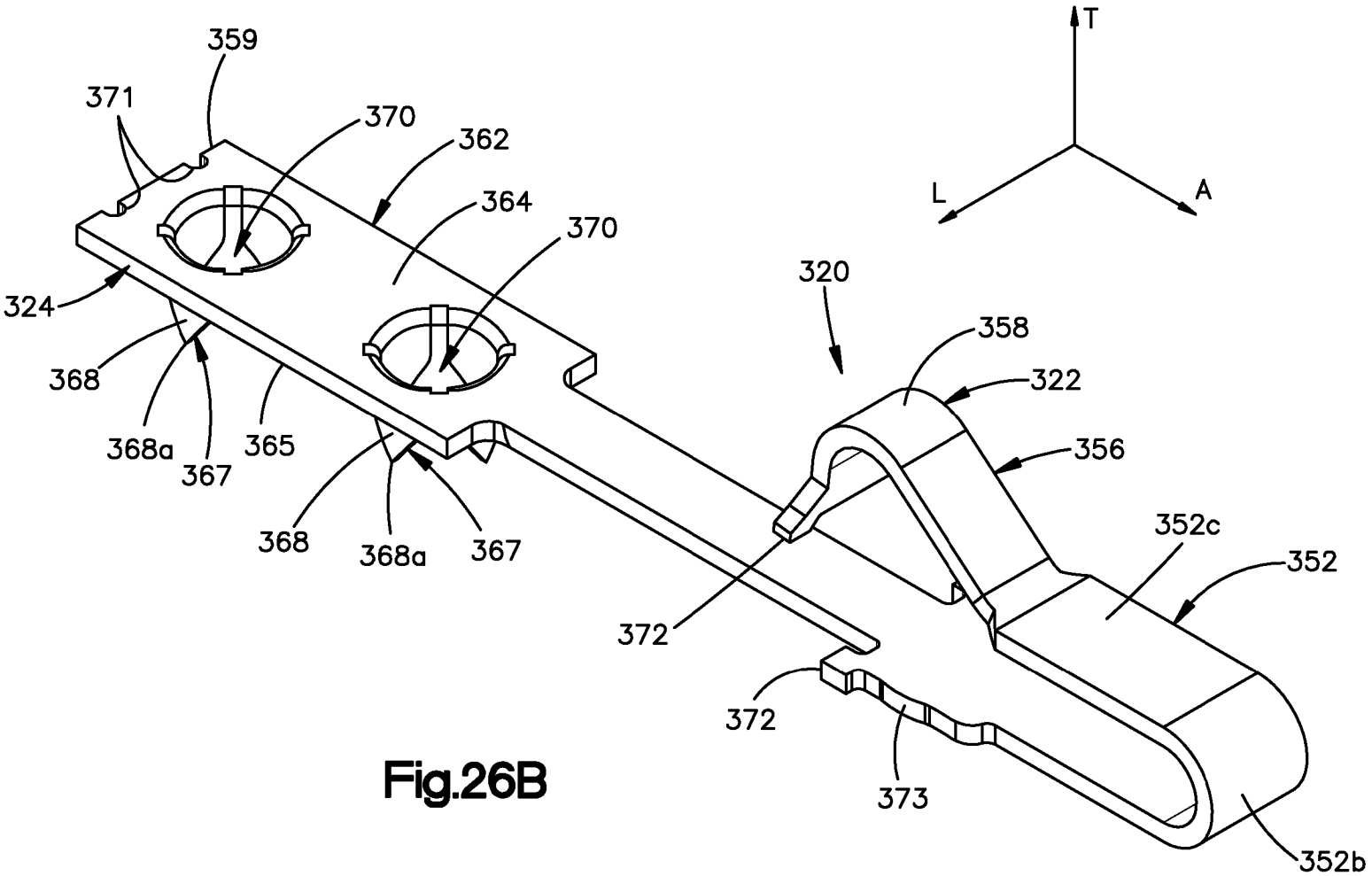
FIG. 26B is a perspective view of the electrical contact illustrated in FIG. 26A, showing the electrical contact in an unbent configuration.

Furthermore, as illustrated in FIGS. 26A-B, the mounting ends 324 can define a retention member that assists in securing the electrical terminal 320 to the connector housing 304. For instance, the mounting plate 362 can include a retention member 371 in the form of one or more recesses that extend into the mounting plate 362, and laterally into the distal end 359 as illustrated, that can receive a complementary engagement member in the form of a complementary projection of connector housing 304. Alternatively, the retention member 371 can be provided as one or more projections that extend out from the mounting plate 362 and are received in complementary recesses of the connector housing 304.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, the various features described and illustrated with respect to the electrical connector 202 and components thereof can be incorporated into the electrical connector 302 and components thereof. Likewise, the various features described and illustrated with respect to the electrical connector 302 and components thereof can be incorporated into the electrical connector 202 and components thereof. Accordingly, those skilled in the art will realize that the invention is intended to encompass all modifications and alternative arrangements included within the spirit and scope of the invention, for instance as set forth by the appended claims.

What is claimed:

1. An electrical terminal comprising:

a mating portion defining a contact surface that is configured to removably electrically connect to an electrical terminal of a complementary electrical component; and a mounting portion including a mounting member and a crimp member that extends from the mounting member, the crimp member having flexible crimp teeth that, when the mounting portion of the electrical terminal is mounted to a flat flex cable, crimp so as to 1) pierce through the flat flex cable along a first direction, and 2) fold back and pierce into the flat flex cable along a second direction substantially opposite the first direction, wherein the crimp member extends from the mounting member along a direction that is substantially parallel to a direction in which the mating portion is spaced from the mounting portion.

2. The electrical terminal as recited in claim 1, wherein the crimp member extends from the mounting member along a direction away from the contact surface.

3. The electrical connector as recited in claim 1, wherein the crimp member extends from the mounting member along a direction toward the contact surface.

4. The electrical terminal as recited in claim 1, wherein the mating portion includes a proximal region, a distal region, and a flexible bent intermediate region connected between proximal region and the distal region, wherein the proximal region defines a contact surface configured to contact a complementary electrical terminal, thereby causing the flexible bent intermediate region to flex such that the proximal region compresses toward the distal region.

5. The electrical terminal as recited in claim 4, wherein the proximal region compresses along a direction that is substantially the same as a direction from which the crimp member extends from the mounting member.

6. The electrical terminal as recited in claim 4, wherein the proximal region compresses along a direction that is substantially opposite a direction from which the crimp member extends from the mounting member.

7. The electrical terminal as recited in claim 4, wherein the proximal region carries a retention member configured to secure the electrical terminal to a connector housing, and the proximal region overlaps the mounting portion.

8. The electrical terminal as recited in claim 7, wherein the distal region overlaps the proximal region and the mounting portion.

9. The electrical terminal as recited in claim 1, further comprising an intermediate portion that is connected between the mating portion and the mounting portion, wherein the mating portion and the mounting portion extend from spaced first and second locations, respectively, of the intermediate portion.

10. The electrical terminal as recited in claim 9, wherein the mating portion and the mounting portion extend from the intermediate portion in the same direction such that the mating portion and the mounting portion overlap each other.

11. The electrical terminal as recited in claim 10, wherein the mating portion defines a proximal region, a distal region, and a bent region that is connected between the proximal and distal regions, such that the proximal and distal regions overlap each other.

12. The electrical terminal as recited in claim 11, wherein the bent region defines a substantially 180° bend.

13. The electrical terminal as recited in claim 1, wherein each of the crimp teeth defines a tapered distal end.

14. An electrical connector assembly, comprising:

a connector housing that includes a first housing surface that defines a mating interface configured to mate with a complementary electrical connector, and a second housing surface that defines a mounting interface that is configured to secure to a flat flex cable;

at least one electrical terminal supported by the housing, the electrical terminal defining a mating portion that faces out from the first housing surface, and a mounting portion that includes at least one crimp member that includes a plurality of crimp teeth that face out from the second surface and are configured to pierce the flat flex cable so as to electrically connect the mounting portion of the electrical terminal to the flat flex cable, the mating portion including a proximal region, a distal region, and a flexible bent intermediate region connected between proximal region and the distal region, wherein the proximal region defines a contact surface configured to contact a complementary electrical terminal, thereby causing the flexible bent intermediate region to flex such that the proximal region compresses toward the distal region; and a strain relief assembly configured to compress the flat flex cable against the connector housing after the mounting portion of the electrical terminal has been electrically connected to the flex cable, wherein the crimp member extends from the mounting member along a direction that is substantially parallel to a direction in which the mating portion is spaced from the mounting portion.

15. The electrical terminal as recited in claim 14, wherein the crimp member extends from the mounting member along a direction away from the mating portion.

16. The electrical connector as recited in claim 14, wherein the crimp member extends from the mounting member along a direction toward the mating portion.

17. The electrical terminal as recited in claim 14, wherein the proximal region compresses along a direction that is substantially the same as a direction from which the crimp member extends from the mounting member.

18. The electrical terminal as recited in claim 14, wherein the proximal region compresses along a direction that is substantially opposite a direction from which the crimp member extends from the mounting member.

19. An electrical terminal comprising:

a mating portion including a proximal region, a distal region, and a flexible bent intermediate region connected between proximal region and the distal region, wherein the proximal region defines a contact surface configured to contact an electrical terminal of a complementary electrical component so as to removably electrically connect to the electrical terminal, thereby causing the flexible bent intermediate region to flex such that the proximal region compresses toward the distal region; and a mounting portion including a mounting member and a crimp member that extends from the mounting member, the crimp member having flexible crimp teeth configured to pierce through a flat flex cable along a first direction so as to mount the flat flex cable to the mounting portion of the electrical terminal, wherein the crimp member extends from the mounting member along a direction that is substantially parallel to a direction in which the mating portion is spaced from the mounting portion.

20. The electrical terminal as recited in claim 19, wherein the proximal region compresses along a direction that is substantially the same as a direction from which the crimp member extends from the mounting member.

21. The electrical terminal as recited in claim 19, wherein the proximal region compresses along a direction that is substantially opposite a direction from which the crimp member extends from the mounting member.

22. The electrical terminal as recited in claim 19, wherein the proximal region carries a retention member configured to secure the electrical terminal to a connector housing, and the proximal region overlaps the mounting portion.

23. The electrical terminal as recited in claim 22, wherein the distal region overlaps the proximal region and the mounting portion.

24. The electrical terminal as recited in claim 19, wherein the flexible crimp teeth are further configured to fold back and pierce into the flat flex cable along a second direction substantially opposite the first direction when crimped so as to mount the flat flex cable to the mounting portion of the electrical terminal.

25. An electrical terminal comprising:

a mating portion defining a contact surface that is configured to removably electrically connect to an electrical terminal of a complementary electrical component;

a mounting portion including a mounting member and a crimp member that extends from the mounting member, the crimp member having flexible crimp teeth configured to pierce through a flat flex cable along a first direction so as to mount the flat flex cable to the mounting portion of the electrical terminal, wherein the crimp member extends from the mounting member along a direction that is substantially parallel to a direction in which the mating portion is spaced from the mounting portion; and an intermediate portion that is connected between the mating portion and the mounting portion, wherein the mating portion and the mounting portion extend from spaced first and second locations, respectively, of the intermediate portion, wherein the mating portion and the mounting portion extend from the intermediate portion in the same direction such that the mating portion and the mounting portion overlap each other.

26. The electrical terminal as recited in claim 25, wherein the mating portion defines a proximal region, a distal region, and a bent region that is connected between the proximal and distal regions, such that the proximal and distal regions overlap each other.

27. The electrical terminal as recited in claim 26, wherein the bent region defines a substantially 180° bend.

28. The electrical terminal as recited in claim 25, wherein the flexible crimp teeth are further configured to fold back and pierce into the flat flex cable along a second direction substantially opposite the first direction when crimped so as to mount the flat flex cable to the mounting portion of the electrical terminal.

29. The electrical terminal as recited in claim 25, wherein the flexible crimp teeth extend from the mounting member in a direction away from the mating portion.

30. The electrical terminal as recited in claim 29, wherein the flexible crimp teeth extend from the mounting member in a direction away from the mating portion.

* * * * *